US005794097A

United States Patent [19]

Shinkawa et al.

[11] Patent Number: 5,794,097

[45] Date of Patent: Aug. 11, 1998

[54] IMAGE FORMING DEVICE WITH RESIDUAL CHARGE REMOVAL CONTROL

[75] Inventors: Kouji Shinkawa, Kitakatsuragi-gun; Masaaki Ohtsuki; Mihoko Okada, both of Yamatokooriyama; Mitsuru Tokuyama, Nara; Hirofumi Sakita, Kitakatsuragi-gun; Masatsugu Nakamura, Kashiba, all of Japan

[73] Assignee: Sharp Kabushiki Kaisha, Osaka, Japan

[21] Appl. No.: 577,918

[22] Filed: Dec. 21, 1995

[30] Foreign Application Priority Data

Dec. 21, 1994 [JP] Japan ..... 6-318344
Mar. 30, 1995 [JP] Japan ..... 7-073131

[51] Int. Cl.[6] ..... G03G 15/00

[52] U.S. Cl. ..... 399/128; 399/50; 399/128; 430/31

[58] Field of Search ..... 399/43, 44, 50, 399/127, 128; 430/31

[56] References Cited

U.S. PATENT DOCUMENTS

| | | | |
|---|---|---|---|
| 4,380,386 | 4/1983 | Yasuda et al. | 399/43 |
| 4,474,455 | 10/1984 | Hirakura et al. | 355/14 R |
| 4,797,707 | 1/1989 | Iwahashi et al. | 399/43 |
| 4,933,721 | 6/1990 | Yasuda et al. | 399/128 |
| 4,935,777 | 6/1990 | Noguchi et al. | 355/210 |
| 5,057,867 | 10/1991 | Ishigaki et al. | 399/43 |

FOREIGN PATENT DOCUMENTS

| | | |
|---|---|---|
| 60-93475 | 5/1985 | Japan . |
| 2-163770 | 6/1990 | Japan . |
| 4-118673 | 4/1992 | Japan . |
| 4-161963 | 6/1992 | Japan . |
| 2 239 105 | 6/1991 | United Kingdom . |

*Primary Examiner*—Joan H. Pendegrass
*Attorney, Agent, or Firm*—David G. Conlin; Milton Oliver

[57] ABSTRACT

The present invention relates to image forming device such as copying machines and laser printers, which use an electrophotographic (xerognaphic) process. A simple control method without using any additional complex means can equalize a surface potentional of a light-sensitive drum to keep a light-quality of an image formed even for the first rotation of the light-sensitive drum. A charge-removal prohibiting means, a charge-potentional changing means and a developing bias-potentional changing means are controlled in accordance with an extent of a change of a surface potential of a light-sensitive body, which depends upon a light fatigue and an ambient temperature of the light-sensitive body and/or a pause after a preceding image process.

6 Claims, 35 Drawing Sheets

| FIG.18A |
| --- |
| FIG.18B |

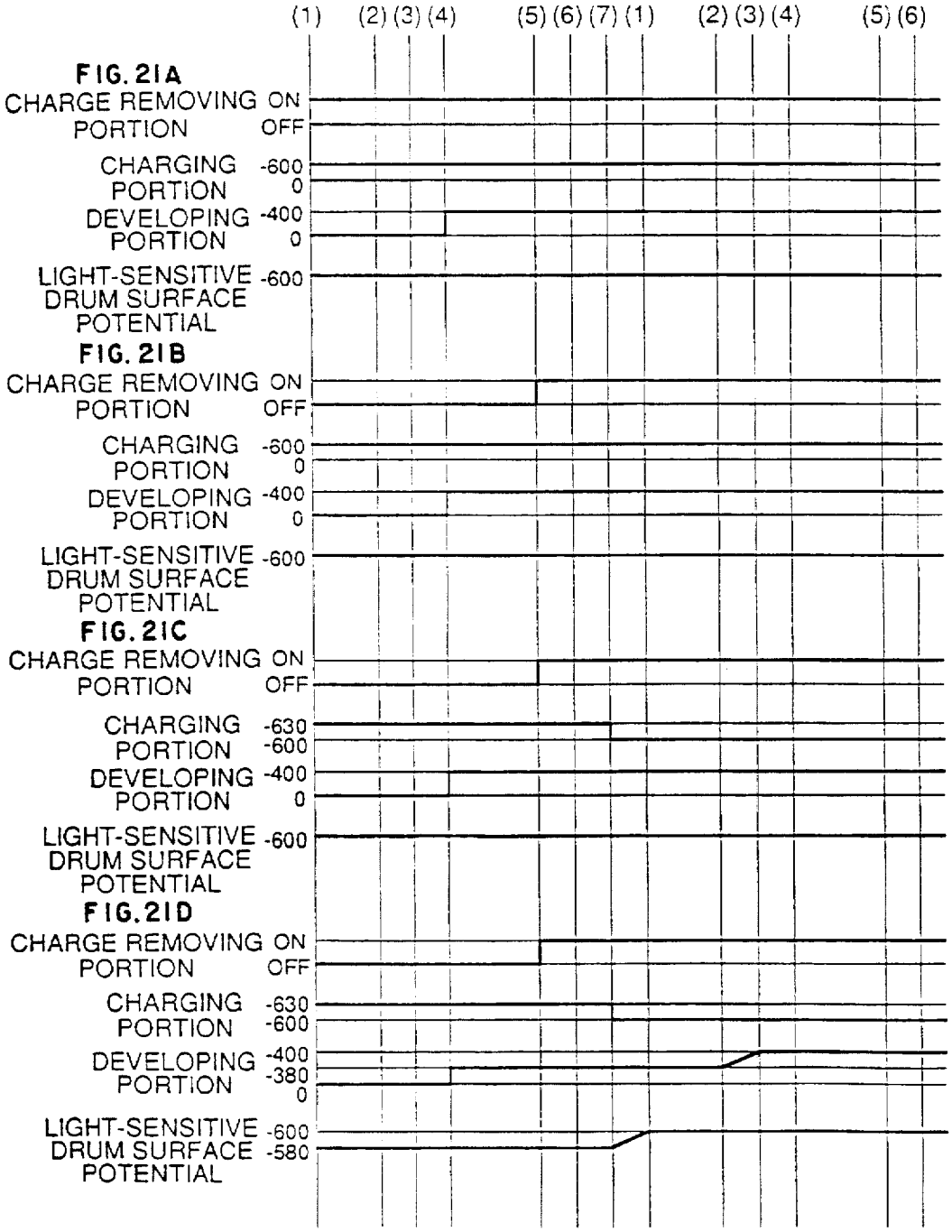
(1) (2) (3) (4) (5) (6) (7) (1) (2) (3) (4) (5) (6)
FIG. 21A
CHARGE REMOVING PORTION ON OFF
CHARGING PORTION -600 0
DEVELOPING PORTION -400 0
LIGHT-SENSITIVE DRUM SURFACE POTENTIAL -600
FIG. 21B
CHARGE REMOVING PORTION ON OFF
CHARGING PORTION -600 0
DEVELOPING PORTION -400 0
LIGHT-SENSITIVE DRUM SURFACE POTENTIAL -600
FIG. 21C
CHARGE REMOVING PORTION ON OFF
CHARGING PORTION -630 -600
DEVELOPING PORTION -400 0
LIGHT-SENSITIVE DRUM SURFACE POTENTIAL -600
FIG. 21D
CHARGE REMOVING PORTION ON OFF
CHARGING PORTION -630 -600
DEVELOPING PORTION -400 -380 0
LIGHT-SENSITIVE DRUM SURFACE POTENTIAL -600 -580

FIG.38

| TEMPERATURE | NUMBER OF FORMED IMAGES | PAUSE | FLAG | | |
|---|---|---|---|---|---|
| | | | Fd | Fc | Fe |
| ≦25℃ | ≦5k | ≦1MIN. | 0 | 0 | 0 |
| | | >1MIN. | 0 | 0 | 1 |
| | >5k | ≦30SEC. | 0 | 0 | 1 |
| | | ≦1MIN. | 0 | 1 | 1 |
| | | >1MIN. | 1 | 1 | 1 |
| OVER 25℃ TO 35℃ INCL. | ≦5k | ≦2MIN. | 0 | 0 | 0 |
| | | ≦3MIN. | 0 | 0 | 1 |
| | | ≦4MIN. | 0 | 1 | 1 |
| | | >4MIN. | 1 | 1 | 1 |
| | >5k | ≦30SEC. | 0 | 0 | 0 |
| | | ≦1MIN. | 0 | 0 | 1 |
| | | ≦2MIN. | 0 | 1 | 1 |
| | | >2MIN. | 1 | 1 | 1 |
| >35℃ | ≦5k | ≦6MIN. | 0 | 0 | 0 |
| | | ≦20MIN. | 0 | 0 | 1 |
| | | ≦30MIN. | 0 | 1 | 1 |
| | | >30MIN. | 1 | 1 | 1 |
| | >5k | ≦5MIN. | 0 | 0 | 0 |
| | | ≦10MIN. | 0 | 0 | 1 |
| | | ≦15MIN. | 0 | 1 | 1 |
| | | >15MIN. | 1 | 1 | 1 |

| | NUMBER OF DRUM ROTATIONS | | |
|---|---|---|---|
| NUMBER OF COPIES | SINGLE COPY | 5 COPIES | 10 COPIES |
| 5k | 18691 | 11214 | 10280 |
| 10k | 37383 | 22428 | 20560 |
| 20k | 74766 | 44856 | 41121 |
| 30k | 112149 | 67284 | 61680 |
| 40k | 149532 | 89712 | 82242 |
| 50k | 186915 | 112149 | 102803 |

FIG.40

| TEMPERATURE | INTEGRATED TIME OF ROTATION | PAUSE | FLAG | | |
|---|---|---|---|---|---|
| | | | Fd | Fc | Fe |
| ≦25℃ | ≦20,000SEC. | ≦1MIN. | 0 | 0 | 0 |
| | | >1MIN. | 0 | 0 | 1 |
| | >20,000SEC. | ≦30SEC. | 0 | 0 | 1 |
| | | ≦1MIN. | 0 | 1 | 1 |
| | | >1MIN. | 1 | 1 | 1 |
| OVER 25℃ TO 35℃ INCL. | ≦20,000SEC. | ≦2MIN. | 0 | 0 | 0 |
| | | ≦3MIN. | 0 | 0 | 1 |
| | | ≦4MIN. | 0 | 1 | 1 |
| | | >4MIN. | 1 | 1 | 1 |
| | >20,000SEC. | ≦30SEC. | 0 | 0 | 0 |
| | | ≦1MIN. | 0 | 0 | 1 |
| | | ≦2MIN. | 0 | 1 | 1 |
| | | >2MIN. | 1 | 1 | 1 |
| >35℃ | ≦20,000SEC. | ≦6MIN. | 0 | 0 | 0 |
| | | ≦20MIN. | 0 | 0 | 1 |
| | | ≦30MIN. | 0 | 1 | 1 |
| | | >30MIN. | 1 | 1 | 1 |
| | >20,000SEC. | ≦5MIN. | 0 | 0 | 0 |
| | | ≦10MIN. | 0 | 0 | 1 |
| | | ≦15MIN. | 0 | 1 | 1 |
| | | >15MIN. | 1 | 1 | 1 |

IMAGE FORMING DEVICE WITH RESIDUAL CHARGE REMOVAL CONTROL

BACKGROUND OF THE INVENTION

The present invention relates to image forming devices such as copying machines and laser printers, which use an electrophotographic (xerographic) process.

In any image forming device using the electrophotographic process, a working cycle consisting of electrostatically charging, exposing to an optical image, developing, transferring and residual charge removing is repeated on a rotating light-sensitive drum. The image forming process may be influenced by the condition of a surface potential of the light-sensitive drum. To realize uniform image formation, it is necessary to create a uniform potential over a whole surface of the light-sensitive drum.

Recently, almost laser printers use light-sensitive bodies made of organic light-sensitive material such as non-metal phthalocyanine or metal phthalocyanine pigment represented by copper or titanium. This is because phthalocyanine light-sensitive material having sensitivity to a long wavelength region is most adequate for the laser radiation as compared with any other organic light-sensitive material. The phthalocyanine pigment is used as light-sensitive bodies in so-called analog copiers using halogen lamps or luminescent lamps as a light-sources since this type pigment can be modified to have an increased light-sensitivity and/or be designed for any desired sensing wavelength region by changing its molecular structure. However, the phthalocyanine pigment has such a drawback that it allows electron traps to easily be formed therein in its nature or by light-fatigue as compared with other organic pigments. For example, an electric charge potential (VO) and a latent image potential (VL) on the light-sensitive drum for the first rotation of the latter can not be maintained by the effect of electron traps produced therein and may be dropped maximum by 200V and 100V respectively at the second and further rotations. Therefore, if all steps of the image forming process are started at a time on the light-sensitive drum, an area of the light-sensitive drum, which extends in the drum rotating direction from a boundary opposed to charging position to the other boundary opposed to a charge removing position just before the drum started rotating, is discharged without being previously charged, thereby resulting in occurrence of a difference in electrical potential between said discharged area and the other area of the drum. This may cause the deterioration of a formed image with uneven optical density and foggy ground in case of reversal developing in a laser printer or decreased image density in case of non-reversal development in an analog copying machine. The above-mentioned problems may be solved by rotating the light-sensitive drum of the device one or more times with charging and discharging to stabilize the surface potential thereon before starting the image forming process. This solution, however, causes a delay in commencement of the image forming process, eliminating the possibility of speeding-up the process.

Accordingly, there have been made several proposals to prevent the image quality deterioration by equalizing a surface potential of the light-sensitive drum and to make it possible to start an image forming process directly from the first rotation by compensating a possible drop of charge potential thereon before starting the second and subsequent rotations, as follows:

Japanese Laid-Open Patent Publication No. 2-163770 discloses an arrangement for controlling a charging output in accordance with a light-fatigue characteristic of a light-sensitive material for a specified period after beginning an image forming process.

Japanese Laid-Open Patent Publication No. 4-118673 also discloses an arrangement for controlling a bias voltage to be applied to a light-sensitive drum according to a time elapsed after stopping picking-up of a preceding image.

Japanese Laid-Open Patent Publication No. 4-161963 further discloses an arrangement for changing conditions of electrically charging, light-exposing and image-developing at the first rotation and the second rotation of a light-sensitive drum.

The above-mentioned conventional control methods, however, could not always equalize potentials enough to form a good-quality image since the above-mentioned potentials VO and VL may vary depending upon the effect of electron traps which may be generated depending upon the extent of accumulated light-fatigue, a temperature of the light-sensitive body and a pause after a preceding image-formation. Furthermore, the prior arts employing the charge potential controlling method require the provision of a static charger driving circuit with a high-voltage power circuit having a wide range of stabilized control, operation of which may also be complicated. The prior arts for controlling a developing bias voltage and changing an output of the exposing light source have like drawbacks.

For example, a multi-layer type light-sensitive organic body which is made by sequentially laminating a carrier generating layer (CGL) of phthalocyanine pigment and a carrier transfer layer (CTL) on a conductive substrate may have, in the CGL layer, a number of electron traps capturing positive charges (positrons). The electron traps are classified into those existing in material itself and those accumulatively produced by the effect of light-fatigue of light-sensitive material through image-forming operations. In an ordinary image-forming process, the light-sensitive body is electrically charged after discharging by light radiation. If an electron trap exists in the CGL layer, a larger amount of pairs of positive and negative charges is produced under the influence of a local electric field of each electron trap therein as compared with the case the light-sensitive body contains no electron trap. The proceeding charging stage causes a negative charge in the light-sensitive body (of the type that positive charges are transferred therein). By the effect of an external field surrounding the negative charge and the local electric field surrounding the electron trap a large amount of positively charged particles from the conductive base is injected into the CGL layer. A part of positive charged particles newly injected and previously produced by the discharging light radiation is captured by the electron trap and the rest passes through the charge transfer layer (CTL) to cancel the negative charge given to the light-sensitivity body, resulting in considerably lowering a surface potential VO and a developing potential VL thereof. At the second and further rotations of the light-sensitive body, the electron traps are neutralized with positive electrons captured therein and, therefore, the potentials VO and VL are stabilized with no affection of the electron traps.

The surface potential of the light-sensitive body may vary depending upon an amount of electron traps. The number of electron traps in the carrier generating layer CGL of the light-sensitive body depends upon the history of use and a temperature of the light-sensitive body and a pause (time elapsed after a preceding image-forming process). Therefore, the drop of a surface potential of the light-sensitive body may be dependent of the history, temperature and pause of the light-sensitive body. The provision of charge-removal prohibiting means and charge potential changing means can not always realize the enough stabilized surface potential of the light-sensitive body.

SUMMARY OF THE INVENTION

It is an object of the present invention to provide an image forming device in which, in case of a pause of image-forming process being of a specified time, the charge removal shall not be conducted for the period that a light-sensitive drum opposed at its part to the electrically charging means at the time of starting an image forming process rotates to oppose the same part to the charge removing means, thereby the light-sensitive drum is not subjected to removal of charge from an area which extends in the drum rotating direction from a part initially opposed to a static charge means to a part initially opposed to the charge removing means can not be subjected to removal of charge before the charging step is completed thereon.

It is an another object of the present invention to provide an image forming device in which the removal of static charge from the light-sensitive drum shall not be conducted until its surface part initially opposed to the electrically charging means at the beginning of an image forming process turns to be opposed to the charge removing means, if either one of the pause condition and the internal temperature condition is satisfied.

It is an another object of the present invention to provide an image forming device in which the removal of static charge from the light sensitive drum shall not be conducted until its surface part initially opposed to the electrically charging means at the beginning of an image forming process turns to be opposed to the charge removing means, if any one of the pause condition, the internal temperature condition and aged characteristic condition is satisfied.

It is an another object of the present invention to provide an image forming device which is capable of preventing variation of a surface potential of a light-sensitive body by prohibiting the charge removing means from removing electrostatic charge before charging and of stabilizing a surface potential of the light-sensitive body for the first time of its rotation by selectively changing a potential of charge to be applied to the electrically charging means for the period the light-sensitive body rotates by 360 degrees to its initial position facing to the electrically charging means to be different from a potential to be applied to the electrically charging means after the first rotation of the light-sensitive body.

It is an another object of the present invention to provide an image forming device which is capable of obtaining the same optical density of an image formed by the first rotation of a light-sensitive body as that being obtainable by the second and further rotations by selectively changing bias potential to a developing means so that a developing potential difference, which is a difference between a potential (VL) of an optical-image exposing portion and a developing bias potential, may be increased enough to obtain the same level of an image density by the first rotation as obtainable by the second and further rotations in case when initial potential is still lower than the specified value to be obtainable by the subsequent rotations.

It is an another object of the present invention to provide an image forming device which is capable of obtaining a good-quality image for the first rotation of a light-sensitive body by adaptively controlling an image forming process in accordance with an extent of a change of a surface potential of the light-sensitive body, which depends upon a light-fatigue and a temperature of the light-sensitive body and/or a pause after the preceding image process.

BRIEF DESCRIPTION OF DRAWINGS

FIG. 21A–21D illustrates 4 different sequences of an image forming process, which can be realized in the fourth embodiment of the present invention.

FIG. 38 is a view showing a principle of setting process parameters of an image forming device, which is the eleventh embodiment of the present invention.

FIG. 40 is a view showing a principle of setting process parameters of an image forming device, which is the twelfth embodiment of the present invention.

PREFERRED EMBODIMENT OF THE INVENTION

Figure 1:
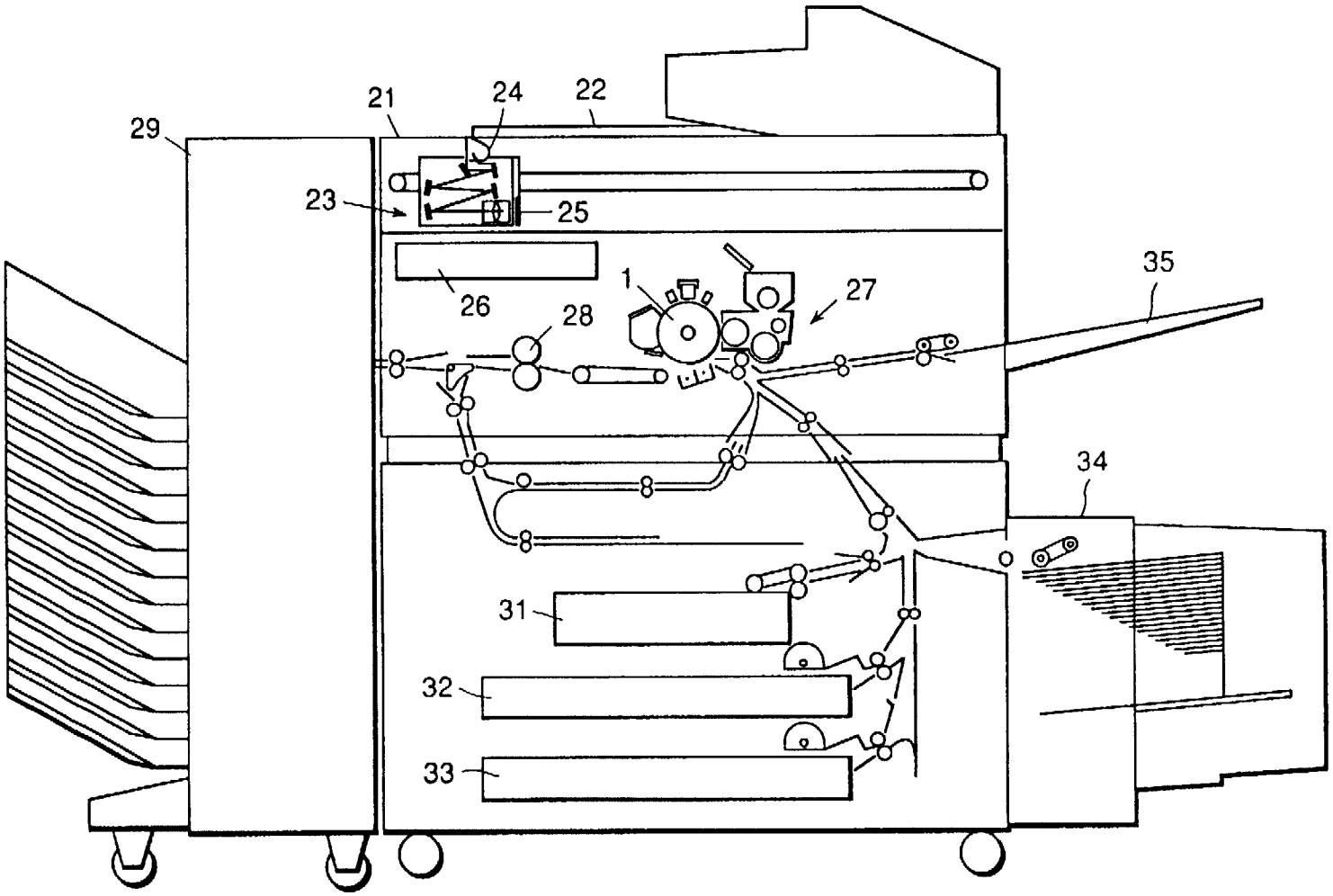
FIG. 1 is a schematic construction view of a first embodiment of an image forming device according to the present invention.

FIG. 1 is a view for schematically showing a structure of an image forming device embodying the present invention.

A digital copying machine 21 which is an image forming device using an electrophotographic (xerographic) process, reads an image of an original placed on an original holding plate 22 provided on the top surface by an optical unit 23 which, moving horizontally underneath the original holder 22, scans the original image with a light beam from a light source 24 and distributes the reflected light to a charge-couple device (CCD) 25. The original image thus read by the CCD 25 is stored as image data in an image memory (not shown).

A laser unit 26 is provided with a semiconductor laser, a polygonal mirror and a lens fθ. The semiconductor laser is driven according to the image data stored in the image memory and image light therefrom is distributed by the polygonal mirror and the lens fθ onto a light-sensitive drum of the processing portion 27. In the processing portion 27, a toner image is formed on a surface of the light-sensitive drum 1 through the process consisting of electrically charging, light exposing and developing and then transferred onto a paper sheet fed from a paper cassette 31–34 through a paper feeding tray 35. Toner image transferred on the paper sheet is heated by a developing pressure roller and fixed thereon by fusing. The paper sheet with the fixed toner image is transported to a sheet delivery provided with a sorter 29.

Figure 2:
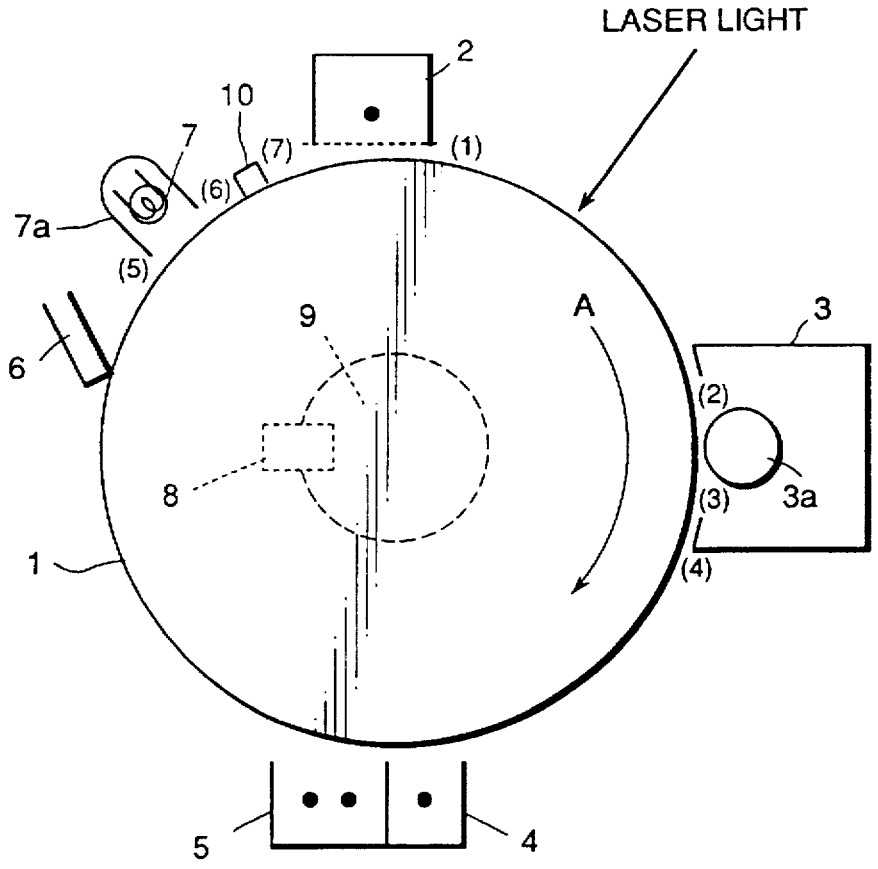
FIG. 2 is a construction view of a processing portion of the first embodiment.

FIG. 2 is a construction view of the processing portion of the above-mentioned digital copying machine. The processing portion has a light-sensitive drum 1 around which a static charger 2, a developing device 3, a transfer charger 4, a sheet separator 5, cleaning blade 6 and a charge removing lamp 7 are disposed as opposed thereto respectively. The light-sensitive drum 1 rotates in the direction shown by an arrow A during the image forming process. The static charger 2 charges the cylindrical surface of the light-sensitive drum 1 with unipolar electrostatic charges. The electrically charged surface of the light-sensitive drum 1 is then exposed to laser light to form a latent image thereon. The latent image is developed with toner supplied from the developing device.

A sheet of paper is transported and placed between the light-sensitive drum 1 and the transfer charger 4 which in turn transfers the toner image from the light-sensitive drum 1 onto the paper sheet. The separator 5 separates the paper sheet from the surface of the light-sensitive drum 1. The cleaning blade 6 removes residual toner from the surface of the light-sensitive drum 1 and the charge removing lamp 7 removes residual charge therefrom. One rotation of the light-sensitive drum 1 is detected by a photo-interrupter 8 disposed in opposite to a slit of a slit disc 9 attached to the axis of the light-sensitive drum 1. A temperature in the processing portion is detected by a temperature sensor 10.

Figure 3:
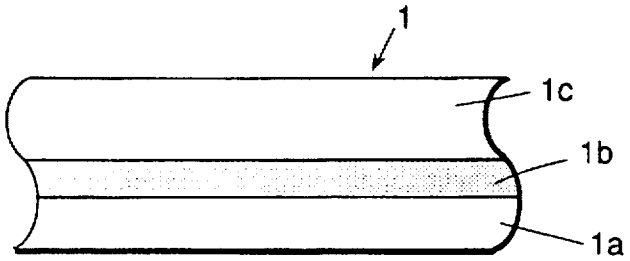
FIG. 3 is an enlarged sectional view of a light-sensitive drum.

FIG. 3 is an enlarged end view of a light-sensitive drum constituting the above-mentioned processing portion. The light-sensitive drum 1 is function separation type light-sensitive organic body that is made by sequentially laminating a 0.5-micron thick carrier generating layer (CGL) 1*b* and a 25-micron thick carrier transfer layer (CTL) 1*c* on a 1 mm thick aluminum-made conductive substrate 1*a*. The carrier generating layer 1*b* is a mixture of copper phthalocyanine pigment (carrier generating material) and polycarbonate (binder resin) in the ratio 1:1 by weight. The carrier transfer layer 1*c* is a mixture of hydrazone material (carrier transfer material) and polycarbonate (binder resin) in the ratio 1:1 by weight. The light-sensitive drum 1 has a diameter of 65 mm.

Figure 4:
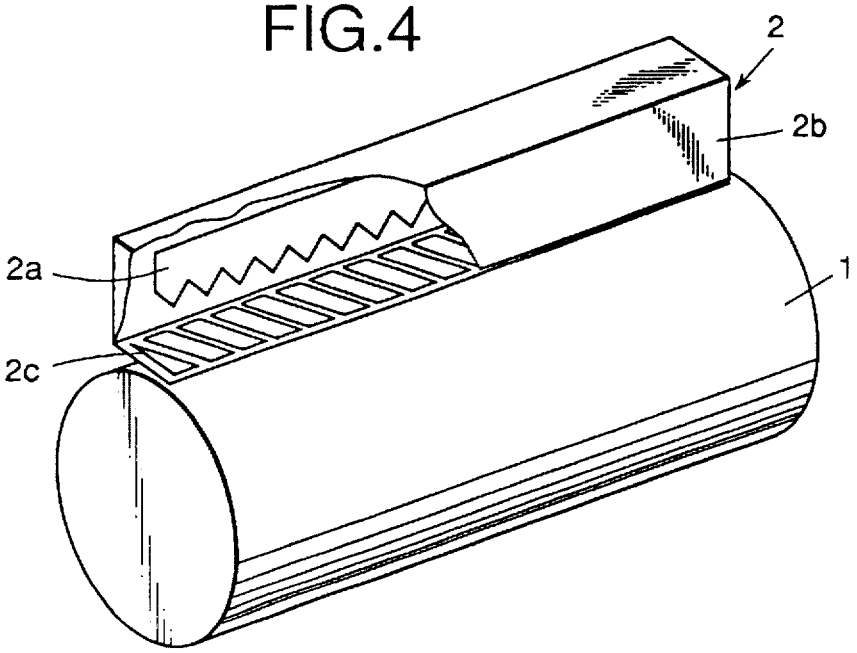
FIG. 4 is a construction view of an electric charger.

FIG. 4 is a construction view of a static charger constituting the above-mentioned processing portion. The static charger 2 disposed in opposite to the light-sensitive drum 1 contains a saw-toothed discharging electrode 2*a* in a case 2*b* with an open surface facing to the light-sensitive drum 1 and has a grid 2*c* attached to the open surface of the case 2*b*.

Figure 5:
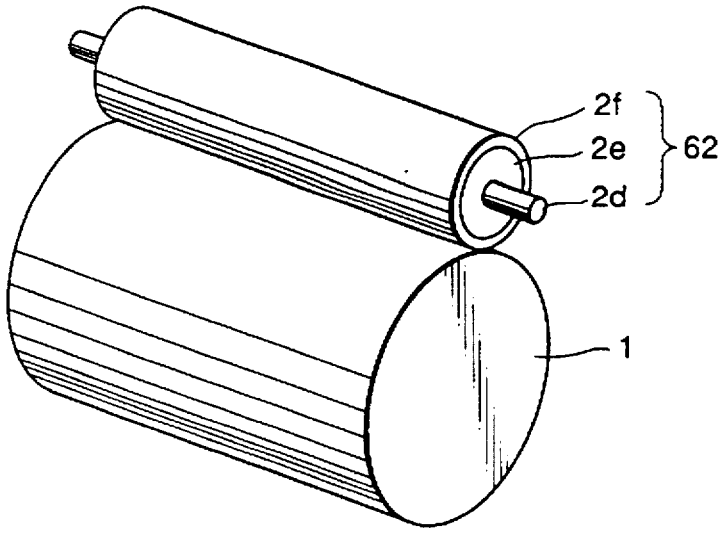
FIG. 5 is a construction view of another electric charger.

It is also possible to use a static charger of FIG. 5, which is a charging roller of about 12 mm in diameter and having a resistance of $10^6$ ohm-cm and JIS-A hardness of 30°. This roller is made of a stainless steel mandrel 2*d* of about 6 mm in diameter and having a 3 mm thick conductive layer 2*e* of urethane rubber with adequately added alumina and a 10–20 micron thick coat 2*f* of insulating nylon.

Figure 6:
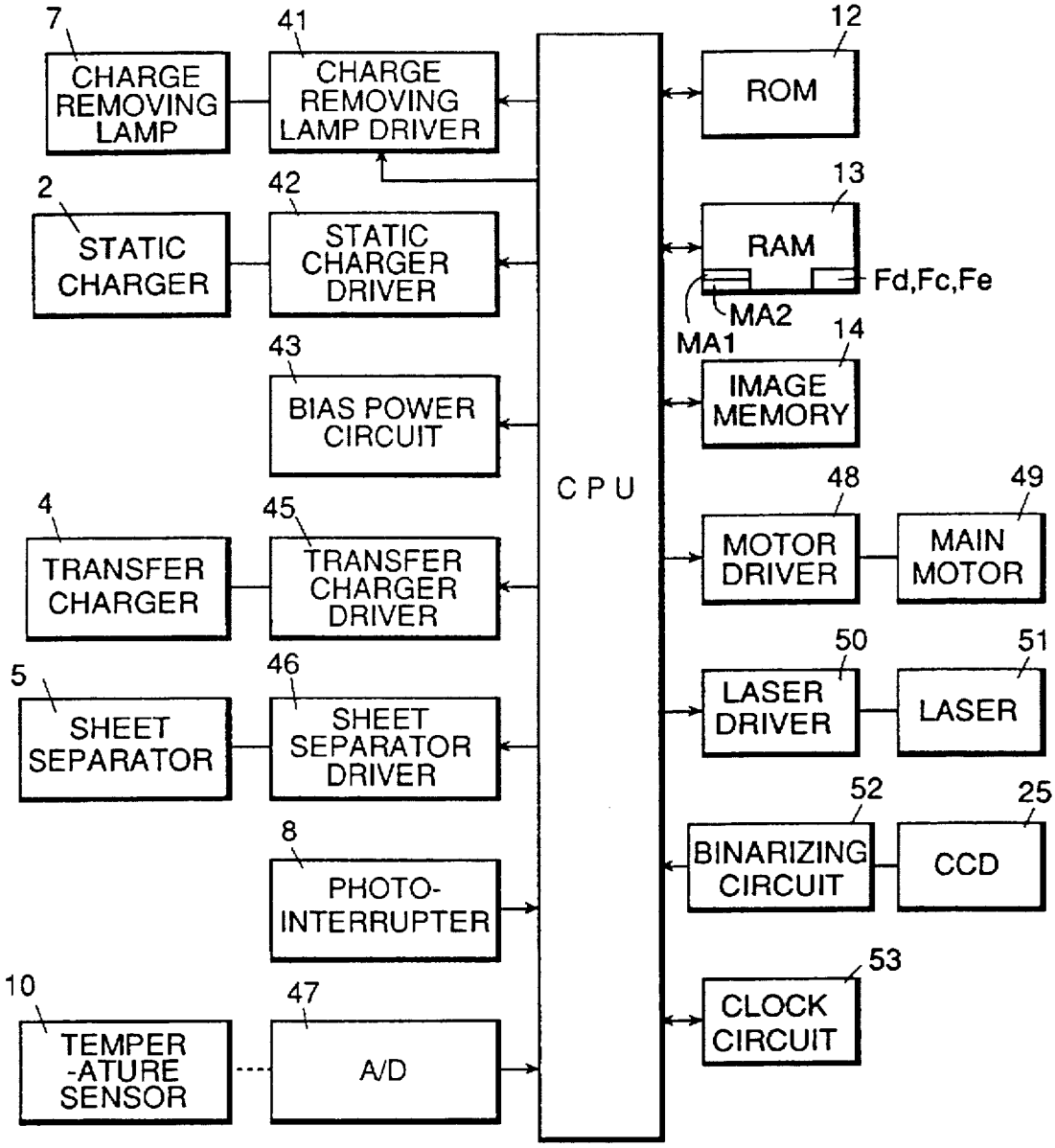
FIG. 6 is a block diagram of a control portion of an image forming device.

FIG. 6 is a block diagram of a control portion of the above-mentioned digital copying machine. The control portion of the digital copying machine is composed of a central processing unit CPU 11 provided with a read-only memory ROM 12, a random access memory RAM 13 and an image data memory 14. The CPU 11 has the connections with a charge removing lamp driver 41, a static charger driver 42, a bias power circuit 43, a transfer charger driver 45, a sheet separator driver 46, a photo-interrupter 8, an A-D converter circuit 47, a motor driver 48, a laser driver 50, a binarizing circuit 52 and a timer circuit 53. The CPU 11 controls these peripheral circuits according to a program stored in the ROM 12. Input data and output data are temporarily stored in the RAM 13.

The CPU 11 receives image data, which is an output signal of CCD 25 entered through a binarizing circuit 52, and stores the received image data in the image memory 14. The CPU 11 also receives a detected signal of the photo-interrupter 8, which is counted by a counter designated for a memory area MA1 of the RAM 13, and determines a rotation angle of the light-sensitive drum 1. The CPU 11 performs judgment on setting/resetting of flags Fd, Fc, Fe which will be described later. The A-D converter 47 enters temperature data detected by a temperature sensor 10 into the CPU 11. The timer circuit 53 independently performs timer processing and the CPU 11 reads the timer processing results and causes the timer to reset and start as the need be.

Figure 7:
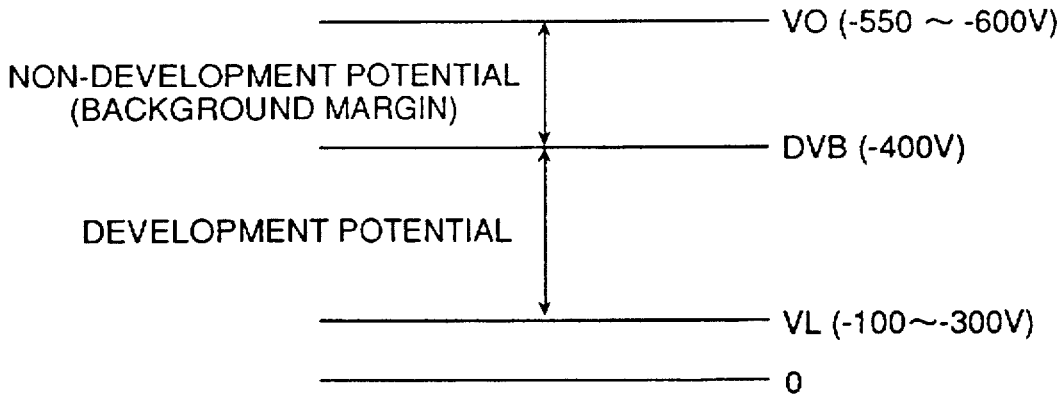
FIG. 7 shows a correlation between a surface potential and a developing bias on a light-sensitive drum.

FIG. 7 shows a correlation between a surface potential of a light sensitive drum and a developing bias in the processing portion. The surface of the light-sensitive drum 1 is charged uniformly with a static charge of potential VO (−550V to −600V) by the static charger 2. When the charged surface of the light-sensitive drum 1 is exposed to a laser image, the different areas thereof are discharged to different extents by the intensity-modulated beam of the laser radiation to produce a latent electrostatic image of latent potential VL (−100V to −300V) thereon. Between the light-sensitive drum 1 and a developing roller 3*a* of the developing device 3, there is applied a developing bias DVB (−400V) which produces a developing potential difference of two potentials—the developing bias potential DVB and the latent image potential VL. The toner is applied from the developing roller 3*a* to the surface of the light-sensitive drum 1 according to the developing potential difference. In the digital copying machine according to the present invention, the image forming process is performed by using the reversal developing method in which the latent image is developed with toner on the light-exposed area on the surface of the light-sensitive drum 1.

Figure 8:
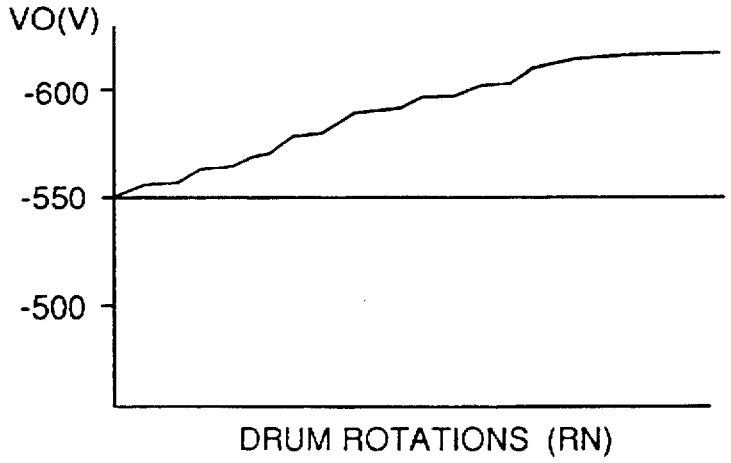
FIG. 8 shows a correlation between rotations and static charge potential of a light sensitive body.

The light-sensitive drum 1, whereon a cycle of electrostatically charging, light-radiation, developing and transferring operations is repeatedly conducted, may have uneven potentials on its surface areas exposed and unexposed to the laser radiation after every developing operation. If the electrically charging step is performed with uneven potentials being left, a potential difference caused in the preceding image-forming process may be accumulated in the current latent image. Such memory of an accumulated residual potential may impair the quality of image to be formed. In addition, areas nearly or entirely unexposed to laser radiation may get an increased charge potential VO as shown in FIG. 8 for rotations of the light-sensitive drum 1, that may impair a uniformity of images formed by respective processes. Accordingly, the surface of the light-sensitive drum 1 is exposed to radiation of the charge removing lamp 7 after the toner image has been transferred therefrom onto a paper sheet so that residual charge may be entirely discharged before starting the charging step of the next image forming process by the static charger 2.

Figure 9:
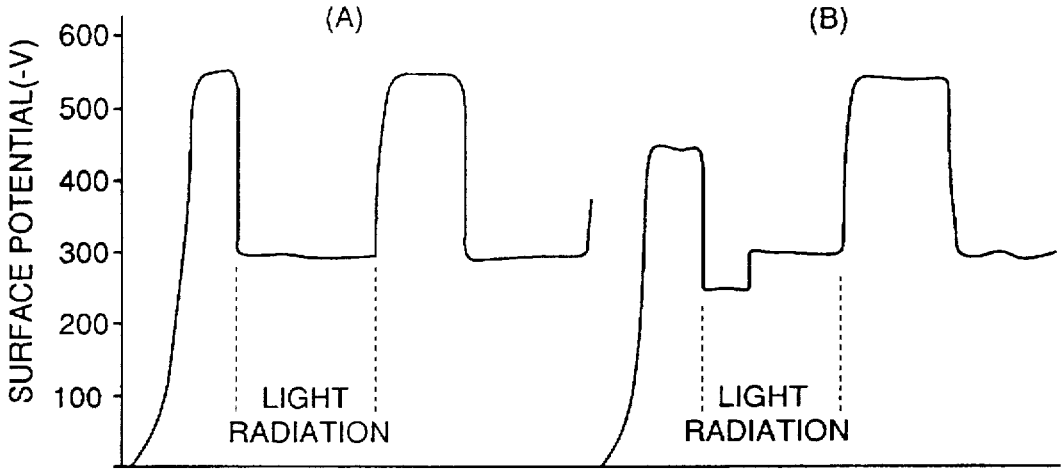
FIG. 9 shows a pause-dependent change of a surface potential of a light sensitive body.

On the other hand, it is known that electron traps exist in a carrier generating layer of the light-sensitive material containing phthalocyanine pigment, which is applied to the light-sensitive drum 1 of the digital copying machine embodying the present invention. These electron traps hinder movement of positive charges and exist in material itself and may also be created and accumulated in the material as the result of luminescence fatigue. The light radiation from the charge removing lamp produces a micro-electric field between each electron trap and the base material of the light-sensitive drum 1 to cause carriers to increasingly enter thereinto, resulting in decreasing the surface potential of the light-sensitive material. Among electron traps, those accumulated in the material by luminescence fatigue may be restored in part but may not be restored in part. The changing condition of the surface potential depends upon a time for which the light-sensitive drum 1 is left as it be. As shown for example in FIG. 9, the surface potential conditions of the light-sensitive drum 1 at the first rotation and at the second rotation are substantially constant (FIG. 9(A)) in case of starting an image forming process immediately after the completion of the preceding image forming process. In case of commencing an image forming process 10 minutes after the completion of the preceding image forming process, there may be a drop of charge potential VO by 100V and a drop of latent image potential VL by 50V (FIG. 9(B)) for a pause of the image forming process within a light-sensitive drum's surface-area from the position opposed to the static charger 2 to the position opposed to the charge removing lamp 7. Such potential drop of the static charge VO decreases a background margin that is a difference between the static charge potential VO and developing bias potential DVB, thereby causing a fogging of non-image area and deterioration of the image formed. The fogging causes toner to excessively adhere to the surface of the light-sensitive drum 1, that may result in increasing a running cost with an increased consumption of toner and a premature wearing of the cleaning blade 6.

Figure 10:
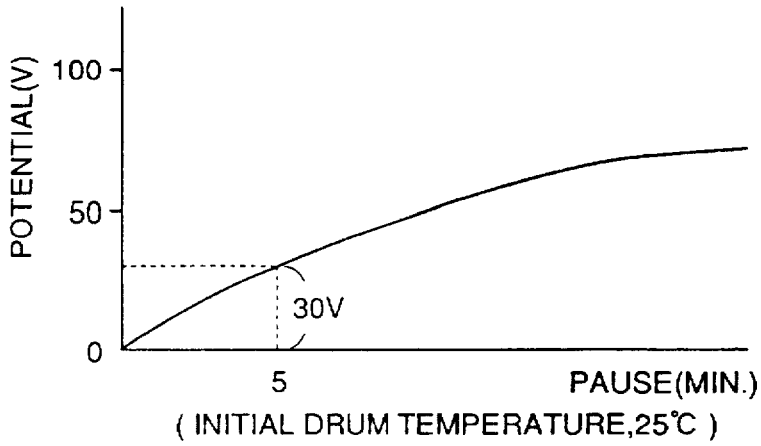
FIG. 10 shows a pause-dependent relation of electric potential difference of non-charged area and other area of a light sensitive body.
Figure 11:
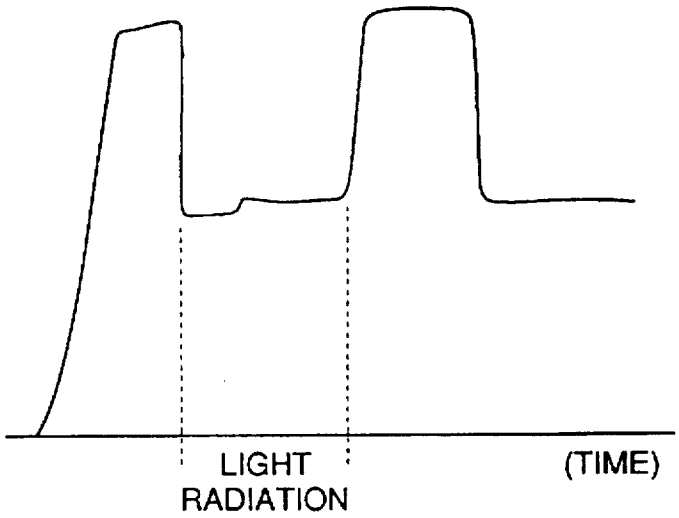
FIG. 11 shows a change of surface potential of a light sensitive body when a process for removing an electric charge from an still uncharged area is omitted.

The applicant has found a correlation of FIG. 10 between a difference in potential on a surface area of the light-sensitive drum 1, said area extending in the drum rotation direction from the portion opposed to the static charger to the portion opposed to the charge removing lamp 7 for a pause between image forming processes (hereinafter called as uncharged area), and the other surface area in relation to a pause between image forming processes, and has succeeded in reducing a potential drop of static charge VO and a drop of the latent image potential VL on the uncharged area as shown in FIG. 11 by prohibiting the charge removing lamp from being driven, if the pause exceeds a certain period, until the uncharged area passes underneath the charge removing lamp 7.

Figure 12:
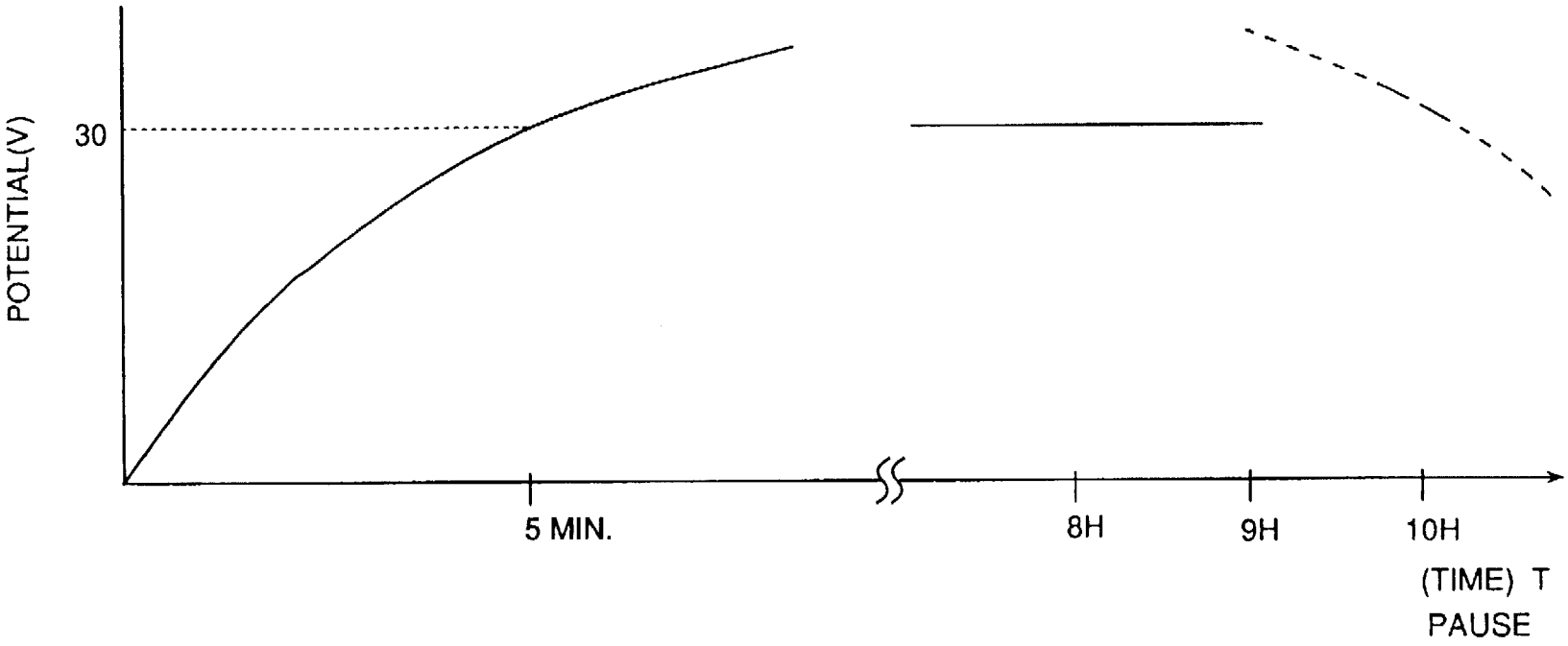
FIG. 12 shows the results of long-term study on a pause-dependent surface-potential difference between a still uncharged area and other area of a light-sensitive body.
Figure 13:
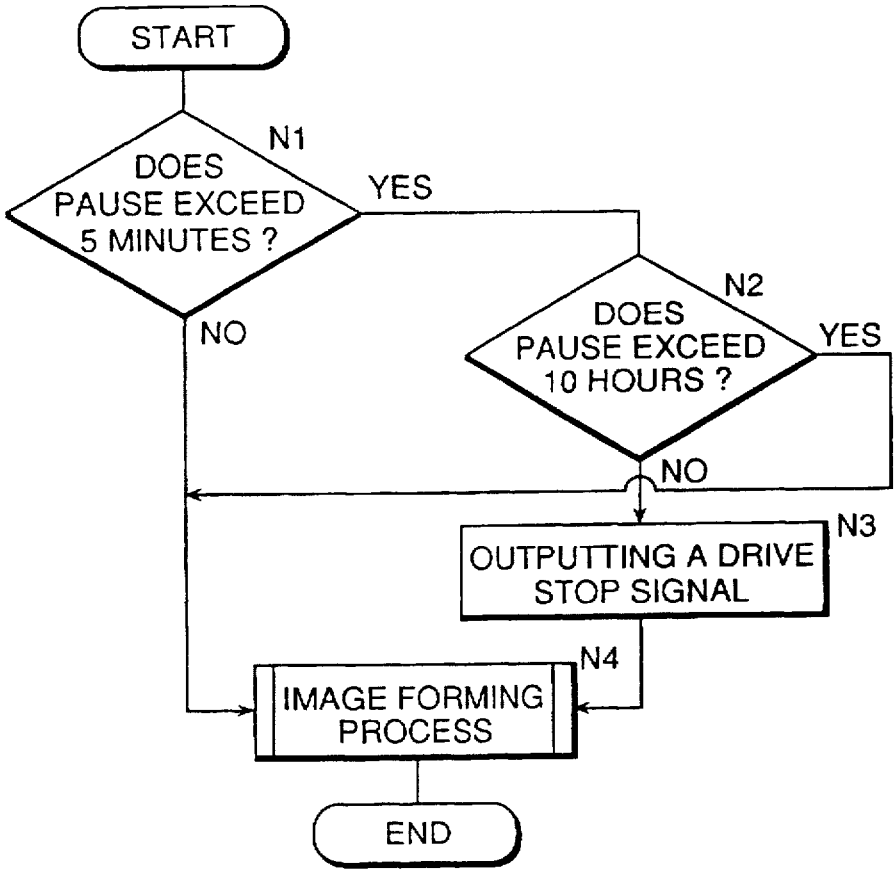
FIG. 13 is a flow chart showing a part of a processing sequence of a control unit of a digital copying machine of the first embodiment of the present invention.

The result of a long-term study of pause-dependent change in potential difference between the uncharged area and the other area of the light-sensitive drum 1 in relation to a pause between the image-forming processes shows that a potential difference on the light-sensitive drum 1 can be restored if a pause is sufficiently prolonged as shown in FIG. 12. Accordingly, CPU 11 performs operations shown in FIG. 13 and gives a stop instruction to the charge removing lamp driver 41 (N3) if a pause between image forming processes exceeds 5 minutes but is not longer than 10 hours (N1, N2). The charge removing lamp driver 41 receives the stop instruction and waits without driving the lamp 7 until the uncharged area of the rotating light-sensitive drum 1 passes underneath the charge removing lamp 7. The light-sensitive drum 1 can rotate at a constant speed irrespective of different magnification factors and, therefore, the time required for passing its uncharged area underneath the charge removing lamp 7 is always constant. The charge removing lamp driver 41 is provided with a delay circuit for delaying outputting a signal for driving the lamp 1. This delay circuit is switched ON when a driver stop signal S1 is inputted thereto.

As described above, the first embodiment of the present invention is capable of realizing high-speed image forming by commencing laser radiation of the rotating light-sensitive drum 1 immediately after an area initially facing to the static charger 2 (for a pause of the image forming process) has moved to the position for laser radiation, keeping the required image quality.

The provision of a reflector 7*a* for the charge removing lamp 7 in addition to the arrangement of the static charger shown in FIG. 4 or charging roller shown in FIG. 5 makes it possible to clearly distinguish the boundary between the uncharged area and the other area, allowing easily presetting waiting time of the charge removing lamp 7 and uniformly forming image by preventing the unstable surface potential from being formed on the surface of the light-sensitive drum 1.

Figure 14:
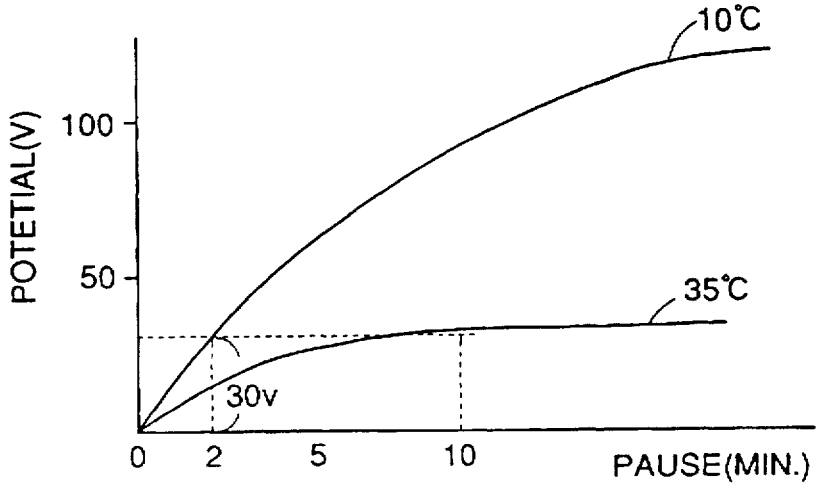
FIG. 14 shows an influence of an ambient temperature on a pause-dependent difference between a still uncharged area and other area of a light-sensitive body.
Figure 15:
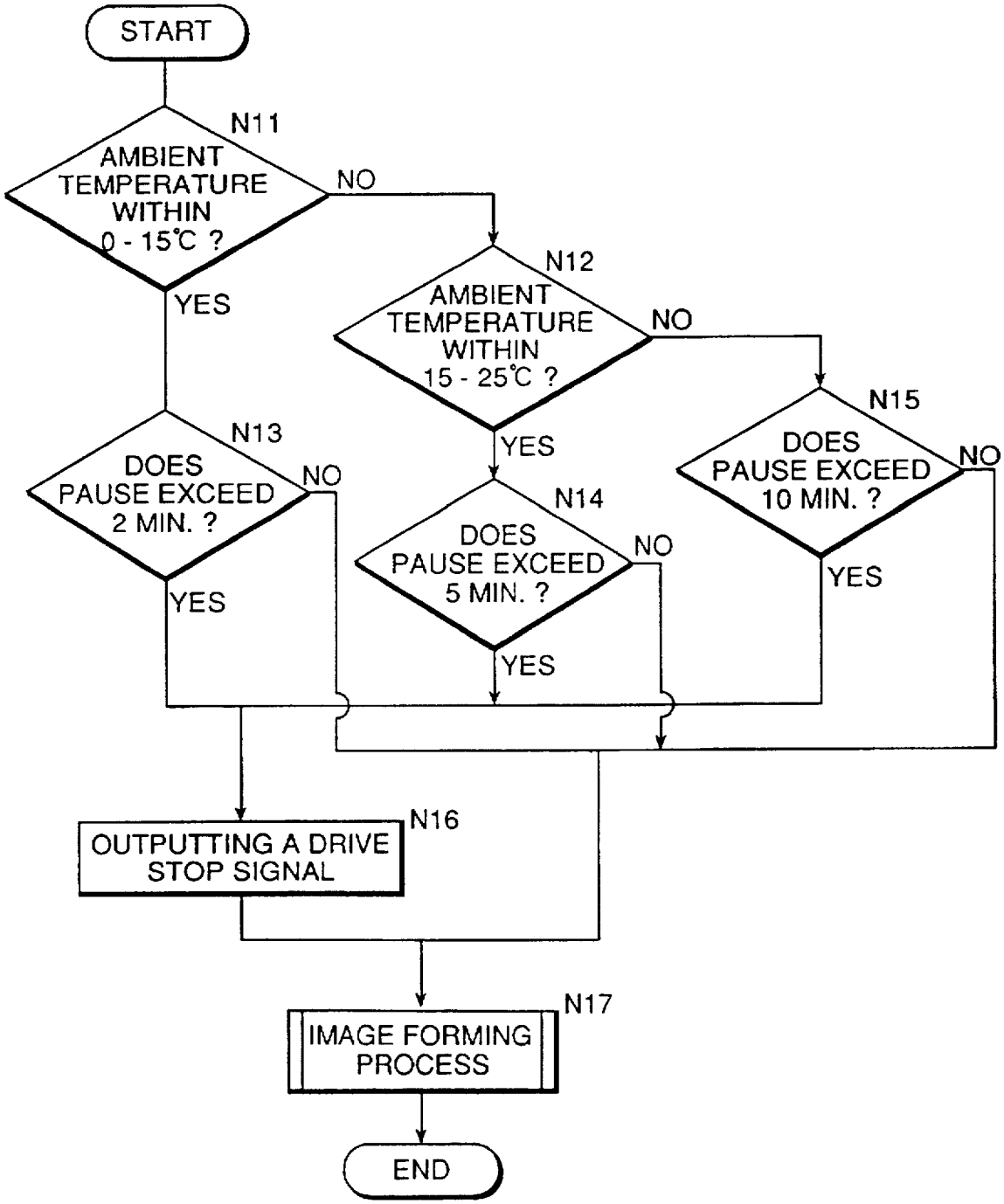
FIG. 15 is a flow chart showing a part of a processing sequence of a control unit of a digital copying machine of the second embodiment of the present invention.

The accumulation of electron traps is influenced by ambient temperature. Accordingly, a change of potential difference between the uncharged area and the other area of the light-sensitive drum 1 depends upon the ambient temperature as shown in FIG. 14. Referring to FIG. 15, the CPU 11 judges the need of providing a signal for driving charge removing lamp according to temperature data inputted from a temperature sensor 10 and a pause between two successive image-forming processes (N11–N15). The CPU 11 output a drive stop signal S1 to the charge removing lamp driver 42 if a pause corresponding to the detected ambient temperature has elapsed (N16).

In the shown second embodiment, it is realized that the lower the ambient temperature is, the earlier the driver stop signal is issued (with a shorter pause). When there is a large difference in potential between the uncharged area and the other area of the light-sensitive drum 1, the uniform image density can be obtained by omitting the charge removing operation for the uncharged area by keeping OFF the charge removing lamp 7.

Figure 16:
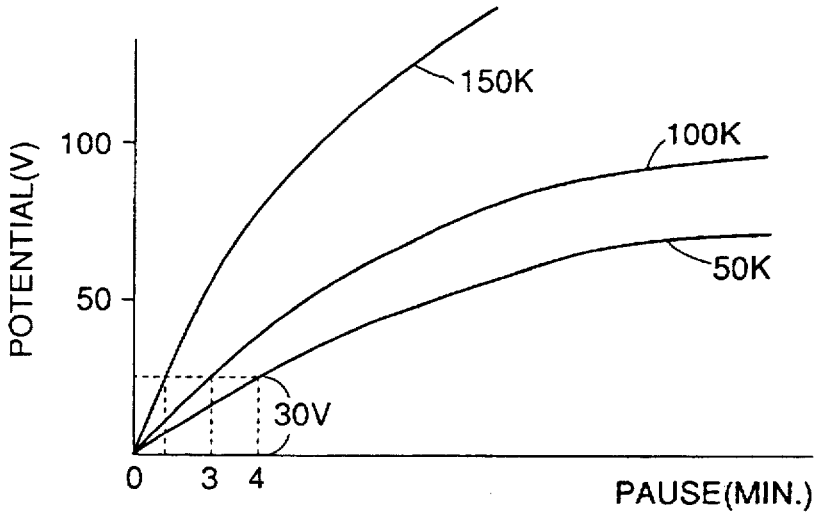
FIG. 16 shows an influence of the number of performed cycles of image forming process on a pause-dependent potential difference between a still uncharged area and other area of a light-sensitive body.

As shown in FIG. 16, a change of potential difference between the uncharged area and the other area of the light-sensitive drum 1 in relation to a pause between image-forming processes depends upon rotations of the light-sensitive drum 1. Increasing the number of rotations of the light-sensitive drum 1 may decrease a pause for reaching a specified potential difference whereat the image quality may be impaired.

Figure 17:
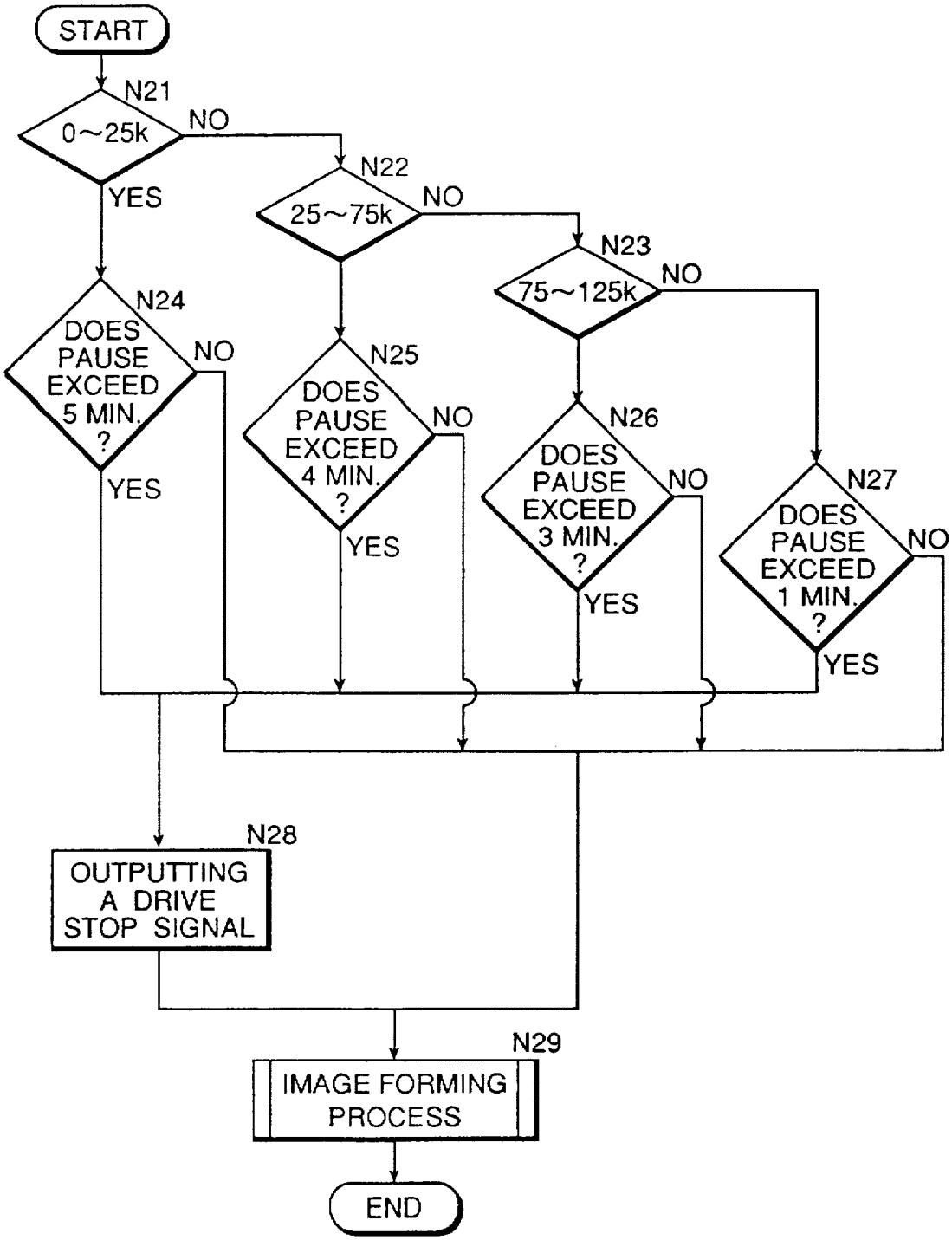
FIG. 17 is a flow chart showing a part of a processing sequence of a control unit of a digital copying machine of the second embodiment of the present invention.

Referring to a flow chart of FIG. 17, the CPU 11 judges whether a driving signal must be given or not (N21–N27) according to the number of rotations of the light-sensitive drum 1, which is counted by a counter assigned for a memory area MA1 of the RAM 13, and a pause between image forming processes. The CPU 11 outputs a drive stop signal S1 to the charge removing lamp driver 42 if a pause corresponding to the detected number of rotations has elapsed (N28).

Figures 18, 18A:
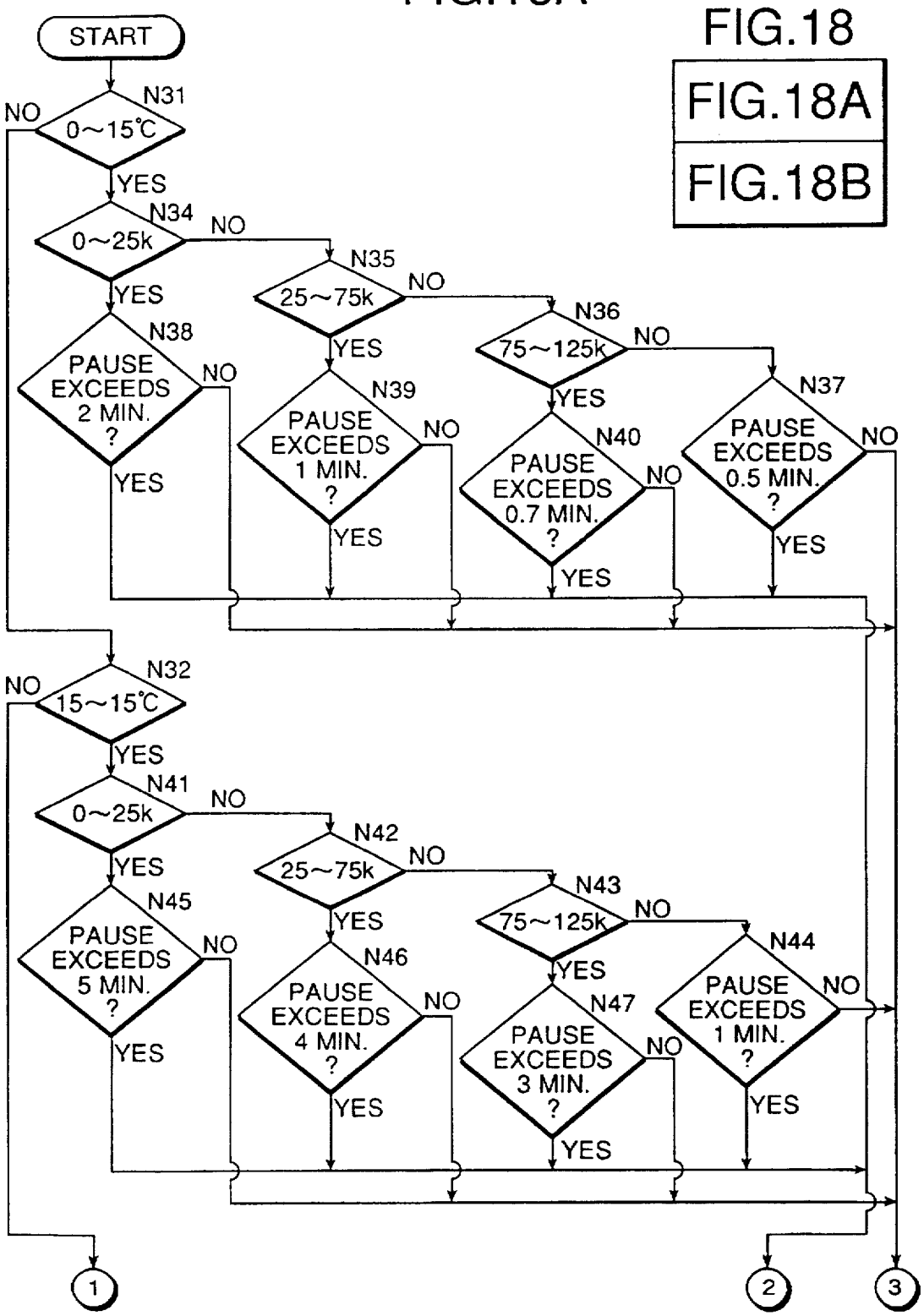
FIG. 18A and 18B are flow charts showing a part of another processing sequence of a control unit of a digital copying machine of the third embodiment of the present invention.
Figure 18B:
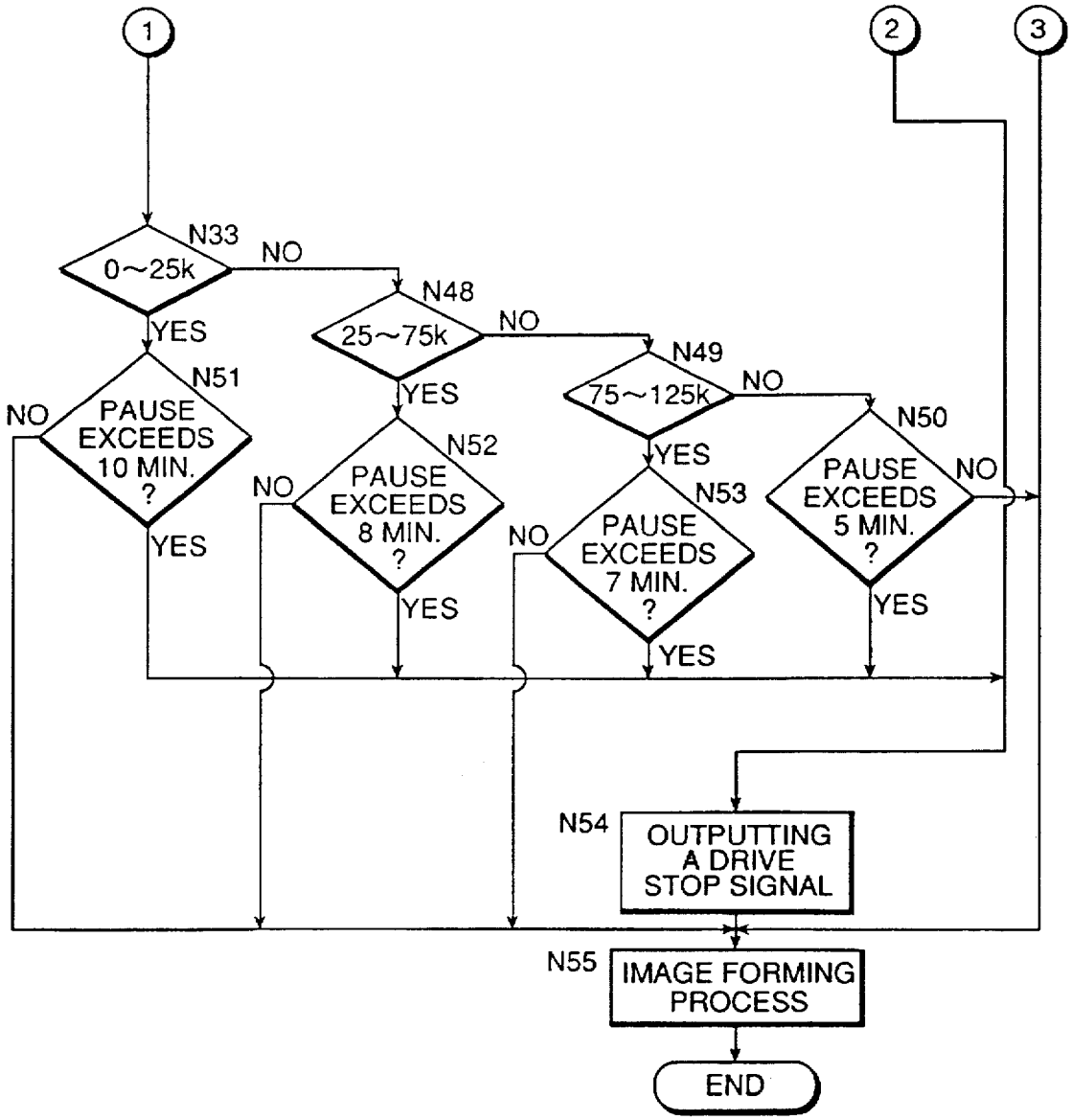

In the shown third embodiment, it is possible to stabilize the formed image quality by omitting the step of removing the residual charge from the uncharged area of the light-sensitive drum in view of the aged characteristics of the light-sensitive drum and a pause between the image forming processes As be apparent from FIGS. 14 and 16, a pause-dependent changing state of a potential difference between the uncharged area and the other area of the light-sensitive drum 1 (in relation to a pause between image-forming processes) may also be influenced by both rotations of the light-sensitive drum 1 and the ambient temperature. Referring to flow charts of FIG. 18A and 18B, the CPU 11 judges whether a driving signal must be given or not (N31–N53) according to the ambient temperature, the number of rotations of the light-sensitive drum 1 and a pause between image forming processes. The CPU 11 outputs a drive stop signal S1 to the charge removing lamp driver 42 if a pause corresponding to the detected number of rotations has elapsed (N54).

According to the above-mentioned sequence of operations, it is possible to omit the step of removing charge by the charge removing lamp 7 from the uncharged area of the light-sensitive drum 1 when the potential difference between the uncharged area and the other area thereof is increased to the extent to influence the image forming state. By doing so, fogging of a non-image area may be prevented with saving the consumption of toner as well as the image forming process can be commenced earlier to create a stable state for uniformly forming an image.

It is known that electron traps exist in a carrier generating layer of the light-sensitive material containing phthalocyanine pigment, which is used for the light-sensitive drum of the shown embodiment of the present invention. These electron traps exist in material itself and may also be created and accumulated in the material as the result of light-fatigue of the material. As described before, the surface potential of the light-sensitive body may decrease with increasing the electron traps. A part of electron traps formed by the effect of the light-fatigue of the material may be restored for a pause-time elapsed and the rest may not be restored. Consequently, a change of the surface potential of the light-sensitive body may vary depending upon a time elapsed after the preceding image-forming process.

Figure 19:
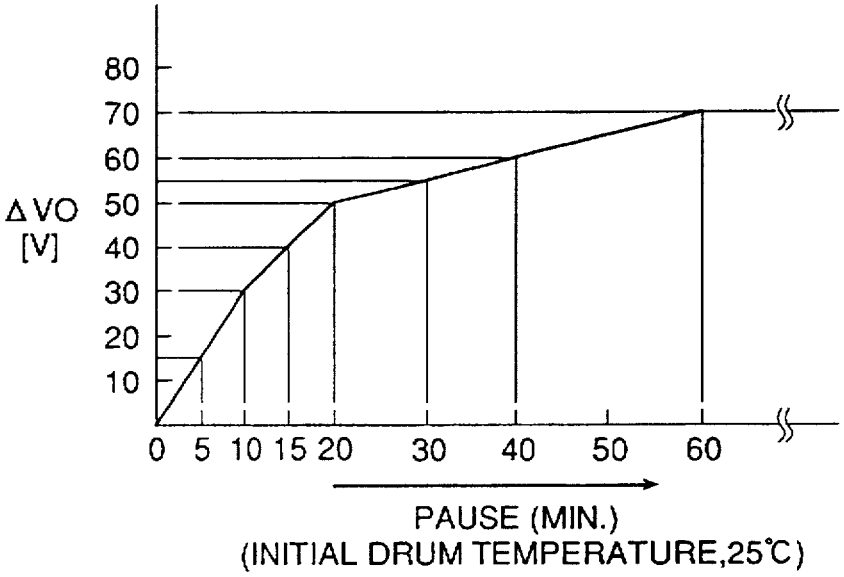
FIG. 19 shows a pause-dependent change of a surface potential of a light sensitive drum.

FIG. 19 shows how much a charge potential VO of the light-sensitive body drops (hereinafter referred as to a charge potential drop ΔVO) depending upon how long a pause between two successive image-forming processes is. (A latent image potential VL may also decrease by the effect of the electron traps but its drop is smaller than VO.) The potential drop ΔVO increases with elongation of a pause and it will get a saturated value of 70V after about 60 minutes. Using the fact that the value of ΔVO varies with a pause after preceding image-forming process, the fourth embodiment of the the present invention, does not perform the charge removal, changing a charging potential and adjustment of a developing bias if a value of ΔVO does not reach 15 V, i.e., the pause is not longer than 5 minutes for which the first rotation of the light-sensitive body may form an image at the same quality as is obtainable by its second and further rotations. The device prohibits the removal of a charge from the light-sensitive body for its first rotation if the value of ΔVO is within the range of 15V to 30V (i.e., the pause is within 5–10 minutes). (This operation is hereinafter referred as to charge-removal prohibiting control.) If the value of ΔVO is within the range of 30V to 40V (this may considerably affect an image to be formed) and the pause is within 10–15 minutes), the device conducts the charge-removal prohibiting control and decreases a voltage to be supplied on the static charger for the first rotation larger than that to be applied for the second rotation (but increases the absolute value). (The latter operation is hereinafter referred as to charger potential changing control.) If the value of ΔVO is within the range of 40V to 70V (this may bring further considerable affection on an image to be formed) and the pause exceeds 15 minutes, the device further increases a developing bias potential for the first rotation higher than that for the second rotation (but decreases its absolute value) to reduce a developing potential difference. (This operation is hereinafter referred as to developing bias-potential changing control.)

Figure 20A:
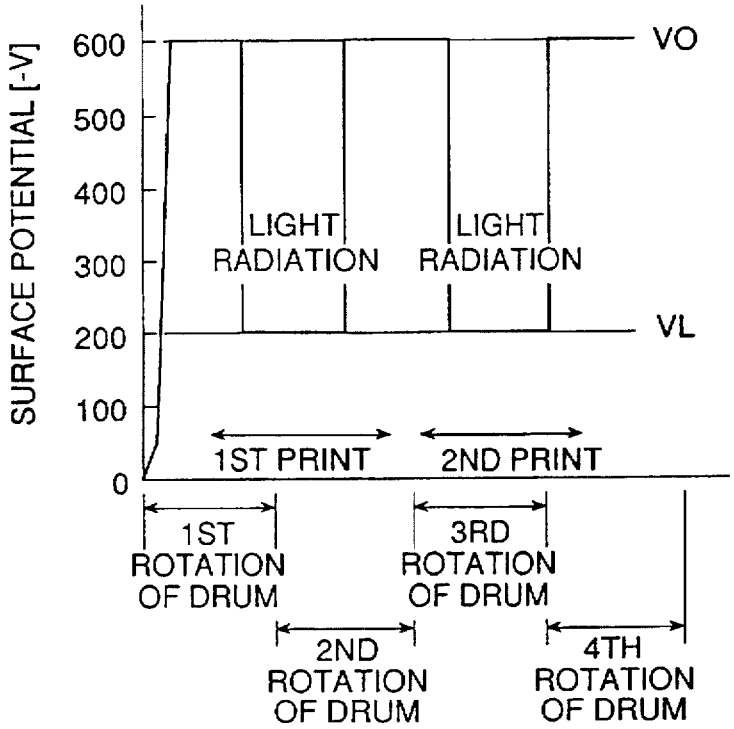
FIG. 20A and 20B show a change of a surface potential depending upon the number of rotations of a light-sensitive drum.
Figure 20B:
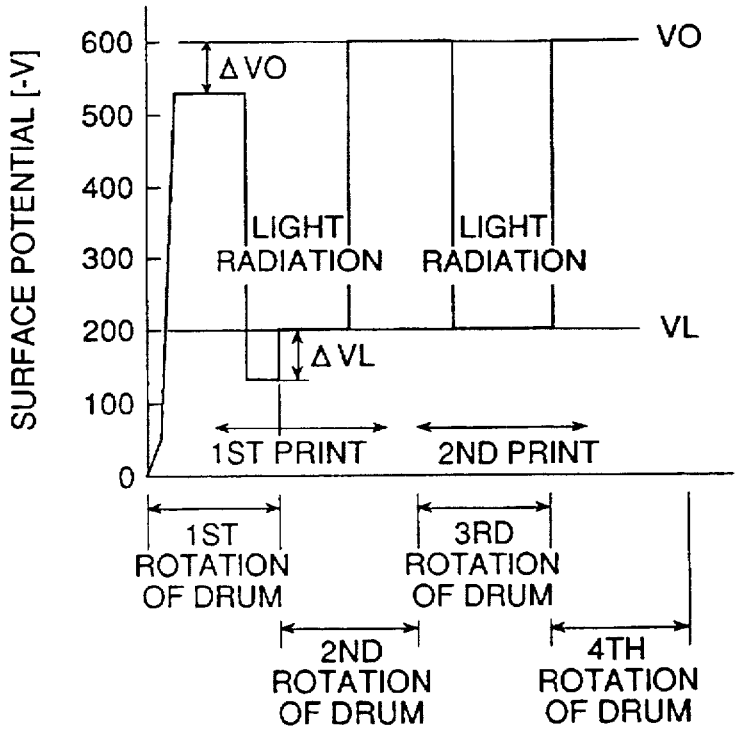

As shown in FIGS. 20A and 20B, the surface potentials of the light-sensitive drum 1 for its first rotation and its second rotation are substantially constant (FIG. 20A) when the image forming process by the first rotation is started immediately after the completion of a preceding image forming process. In case of commencing an image forming process 60 minutes after the completion of the preceding image forming process, there may be a drop of charge potential VO by 70V and a drop of latent image potential VL by 50V (FIG. 20B) within a light-sensitive drum's surface-area from the position initially opposed to the static charger 2 to the position initially opposed to the charge removing lamp 7. Such potential drop of the static charge VO decreases a background margin that is a difference between the static charge potential VO and developing bias potential DVB (FIG. 7), thereby causing fogging on non-image area and deterioration of the image formed. The fogging causes toner to excessively adhere to the surface of the light-sensitive drum 1, that may result in increasing a running cost with an increased consumption of toner and a premature wearing of the cleaning blade 6. Therefore, in this case, the device prohibits removal of a charge from the light-sensitive drum 1 for its first rotation, decreases (but increase in absolute value) a voltage to be applied to the static charger for the first rotation and increases (but decreases in absolute value) a developing bias-potential for the first rotation.

FIGS. 21A–21D are timing charts of 4 different image-forming processes. FIG. 21A relates to an ordinary image-forming process when a pause is not longer than 5 minutes. Numbers (1), (2), (3), (4) . . . (7) correspond to respective positions around the light-sensitive drum shown in FIG. 2. In the process of FIG. 21A, as soon as the light-sensitive drum 1 starts rotation, the charge removing lamp 7 is turned ON and a voltage of –600V is applied to a grid of the static charger 2, thereby the rotating light-sensitive drum has a surface potential of –600. The developing bias potential of –400V is supplied from the time when a leading position (1) on the charged surface of the rotating light-sensitive drum passed the underneath of the developing device. FIG. 21B relates to an image-forming process using the charge-removing control. A voltage of –600V is applied to the grid of the static charger as soon as the light-sensitive drum starts rotation, the charge removing lamp is kept in OFF position until the leading position on the charged surface of the rotating light-sensitive drum arrives at the underneath of the charge removing lamp 7. The lamp is then turned ON. FIG. 21C relates to an image-forming process using the charge-removing control and the charge potential changing control. A voltage of –630V is applied to the grid of the static charger 2 as soon as the light-sensitive drum starts rotation. When the leading position on the charged surface of the rotating light-sensitive drum returned to the initial position under the static charger 2, the grid potential of the static charger is switched-over to –600V. FIG. 21D relates to an image-forming process using the charge-removing control, the charge potential changing control and the developing bias-potential changing control. The developing bias-potential is adjusted first at –380V when the leading position on the surface of the rotating light-sensitive drum passed the underneath of the developing device 3. The bias-potential is then lowered (increased in absolute value) gradually to –400V, thereby the surface potential of the light-sensitive drum becomes –580V for its first rotation and –600V for the second and further rotations.

Figure 22:
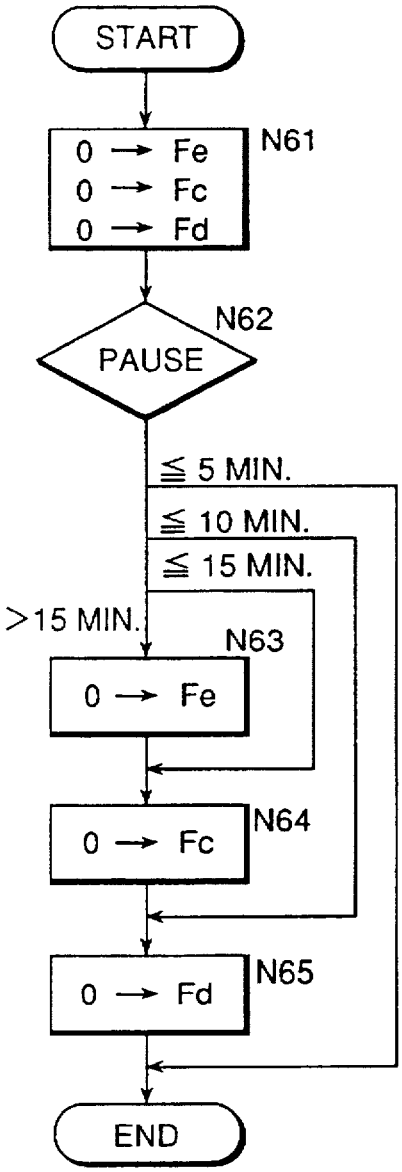
FIG. 22 is a flow chart showing a processing procedure of a control portion of the fourth embodiment of the present invention.

Referring to flow charts of FIGS. 22 and 23, the operation of the central processing unit CPU of the control portion will be explained as follows:

The flow chart of FIG. 22 is descriptive of setting process parameters. The CPU first resets a flag Fe indicating performing the charge-removal prohibiting control, a flag Fc indicating performing the charger-potential changing control and a flag Fd indicating performing the developer bias-potential changing control (N61), then reads data on the time (pause) elapsed after a preceding image-forming process from the timer circuit 53 and finishes the processing if the time is less than 5 minutes. In this case, the flags Fe, Fc and Fd are kept as reset. When the time exceeds 5 minutes and is not more than 10 minute, the flag Fe is set (N62→N65). When the time exceeds 10 minutes and is not more than 15 minutes, the flag Fc and Fe are set (N62→N64→N65). If the time exceeds 15 minutes, all flags Fd, Fc and Fe are set (N62→N63→N64→N65).

Figure 23:
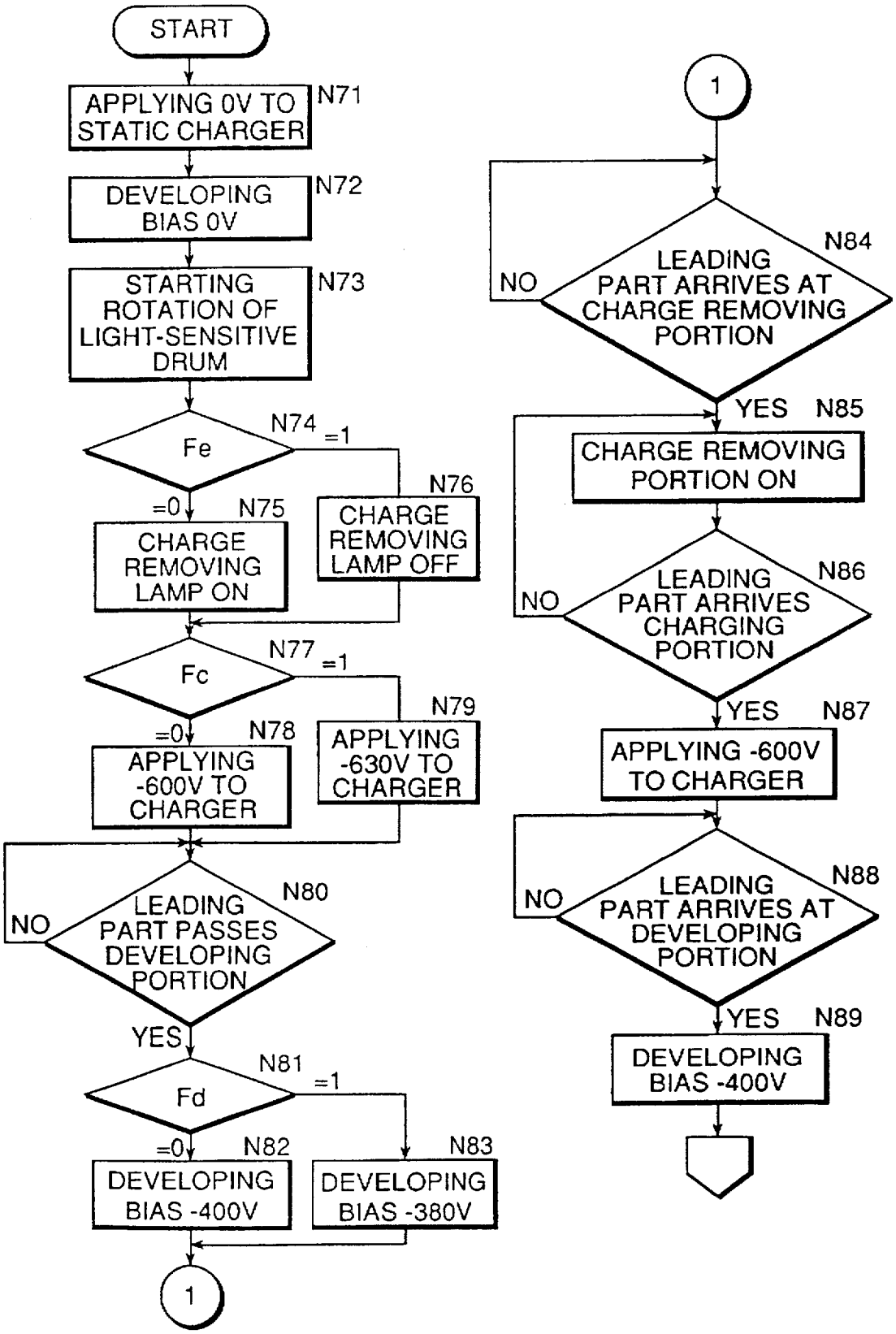
FIG. 23 is a flow chart showing a processing procedure of a control portion of the fourth embodiment of the present invention.

FIG. 23 shows a procedure of operations for an image forming process, which shall be carried out after setting the above-mentioned process parameters. The CPU sets a grid potential of the static charger at 0V and a developer bias potential at 0V, then starts the light-sensitive drum into rotation (N71→N72→N73). The CPU keeps the charge-removing lamp 7 in the OFF position when the flag Fe is set (N74→N76) or turns the lamp ON when the flag Fe is in the unset state (N75). The CPU applies a voltage –630V to a grid of the static charger 2 when the flag Fc is set (N77→N79) or applies a voltage –600V thereto when flag Fc is in the unset state (N78). The CPU waits until the leading position on the surface of the rotating light-sensitive drum passes the developing portion (N80) (i.e., the position (1) on the surface of the light-sensitive drum arrives at the position (4)). When the leading position on the surface of the rotating light-sensitive drum passed the developing portion, the CPU supplies a developer bias potential –380V when the flag Fd is set (N81→N83) or supplies –400V when the flag Fd is in the unset state (N81). The CPU then waits until the leading position on the surface of the rotating light-sensitive drum arrives at the charge-removing portion, i.e., the position (1) shown in FIG. 2 reaches to position (5) shown in FIG. 2 (N84). When the leading position on the surface of the rotating light-sensitive drum arrives at the charge removing portion, the CPU turns the charge removing lamp 7 ON and waits until the leading position reaches to the static charger portion (N85→N86). When the leading position arrived at the static charger portion, the CPU keeps or changes the grid potential of the static charger 2 at or to –600V (N87). (The grid potential is kept at –600V if the flag Fc has been in the unset state and is changed from –630V to –600V if the flag Fc has been set.) The CPU waits until the leading position appears again underneath the developing portion. When the leading position arrives at the developing portion, the CPU supplies a developer bias potential –400V (N88→N89). (The developer bias potential is kept at –400V if the flag Fd has been in the unset state and is changed from –380V to –400V if the flag Fd has been set.)

As described above, the CPU performs the process shown in FIG. 21(A) when all flags Fe, Fc and Fd being in the unset (0) state, performs the process shown in FIG. 21(B) when Fe=1, Fc=0 and Fd=0, performs the process shown in FIG. 21(C) when Fe=1, Fc=1 and Fd=0 and performs the process shown in FIG. 21(D) when Fe=1, Fc=1 and Fd=1.

Figure 24:
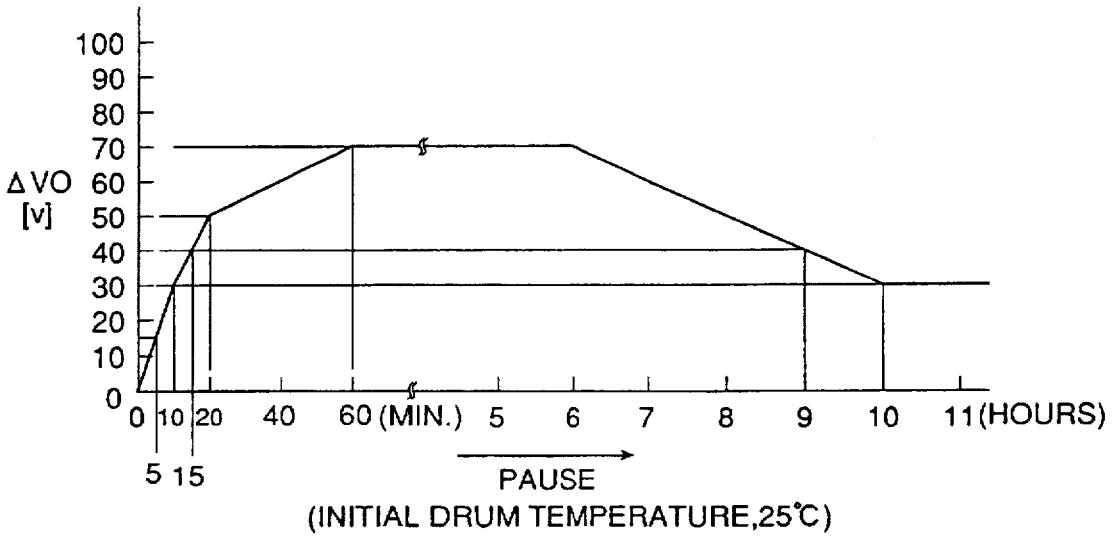
FIG. 24 shows a pause-dependent change of a surface potential of a light-sensitive drum, which is applied to the fifth embodiment of the present invention.
Figure 25:
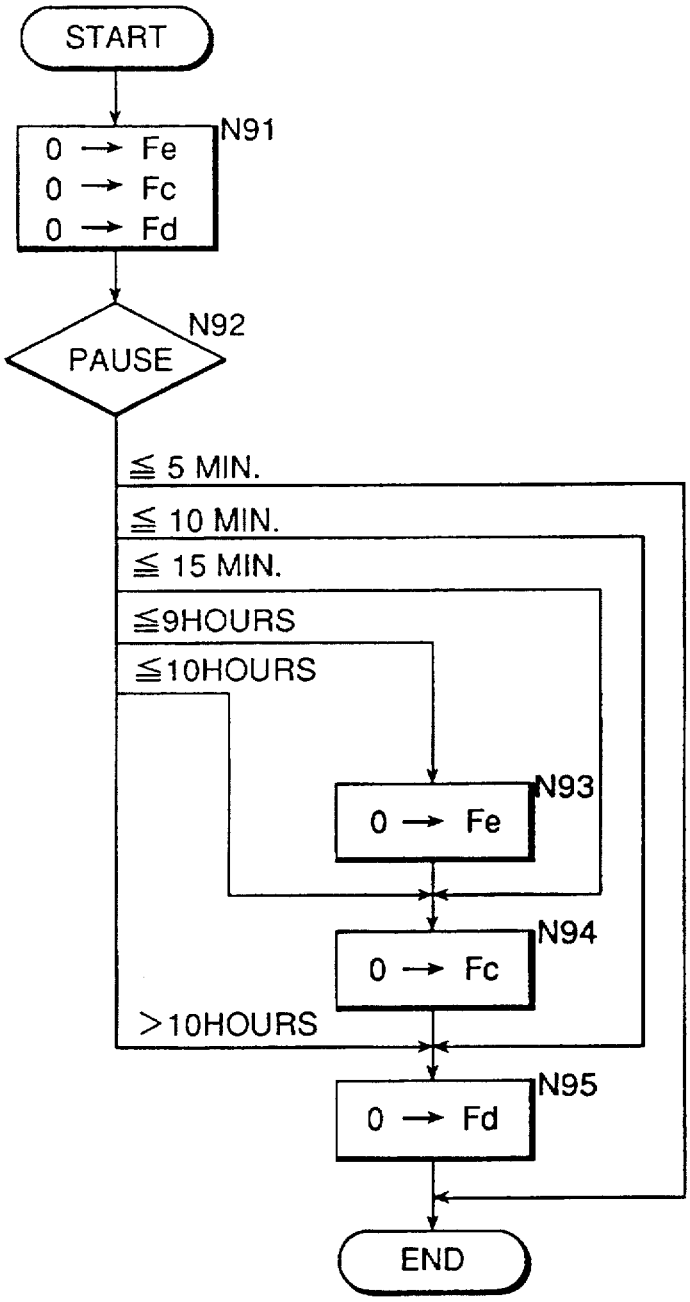
FIG. 25 is a flow chart showing a processing procedure of a control portion of the fifth embodiment of the present invention.

Referring now to FIGS. 24 and 25, the structure of the fifth embodiment of an image-forming device according to the present invention will be described as follows:

A pause-dependent drop ΔVO of a surface potential VO of the light-sensitive body was further studied in a long-term condition, which result is shown in FIG. 24. Namely, the value of ΔVO increases with increasing pause (time interval from the preceding process) in such a relationship that it increases and is saturated in 60 minutes, remains at the same level for a subsequent period extending to 6 hours, gradually decreases for a subsequent period extending to 10 hours and stabilized at 30V after 10 hours. This phenomenon may be explained by that electron traps accumulated by the effect of the light-fatigue of the light-sensitive material disappear one after another to an extent for a long interval from the preceding image-forming process, reducing their effect on the value of ΔVO. Accordingly, the fifth embodiment of the present invention performs the operations of FIG. 25 to set process parameters to adapt for use after the long interval of no less than 6 hours. A flag Fe indicating performing the charge-removal prohibiting control, a flag Fc indicating performing the charger-potential changing control and a flag Fd indicating performing the developer bias-potential changing control are first reset respectively (N91), then data on the time (pause) elapsed after the preceding image-forming process is read from the timer circuit 53 and the processing is ended if the time is less than 5 minutes. In this case, the flags Fe, Fc and Fd are left as unset. When the time is in excess of 5 minutes but is not more than 10 minute, the flag Fe is set (N92→N95) . When the time exceeds 10 minutes and is not more than 15 minutes, the flags Fc and Fe are set (N92→N94→N95). When the time exceeds 15 minutes and is not more 9 hours, all flags Fd, Fc and Fe are set (N92→N93→N94→N95). When the time exceeds 9 hours and is not more than 10 hours, the flags Fc and Fe are set (N92→N94→N95). If the time is in excess of 10 hours, the flag Fe is set (N92→N95).

After completion of setting the above-mentioned process parameters, this embodiment performs the same control operations as the fourth embodiment according to the procedure shown in FIG. 23 in case when an interval (pause) after a preceding image-forming process is not more than 9 hours for which the value of ΔVO may be decreased to 40V. When the interval is within 9–10 hours, the value of ΔVO is reduced to 30V –40V. Therefore, in this case, the developer bias-potential control is omitted and the charge-removal prohibiting control and the charger-potential changing control are conducted. When the interval exceeds 10 hours, the value of ΔVO is decreased to 30V and, therefore, only the charge-removal prohibiting control is carried out. The above-mentioned control facilities are effectively applied for example in a laser printer provided with facsimile function, which is in the waiting state in night with its power switch ON to receive an message and print out it, and which in any time can always obtain the stabilized quality of an image with no fog on the ground by selectively performing the charge removal prohibition control, charger potential changing control and developer potential changing control depending upon a time elapsed after a preceding image-forming process performed therein.

Figure 26:
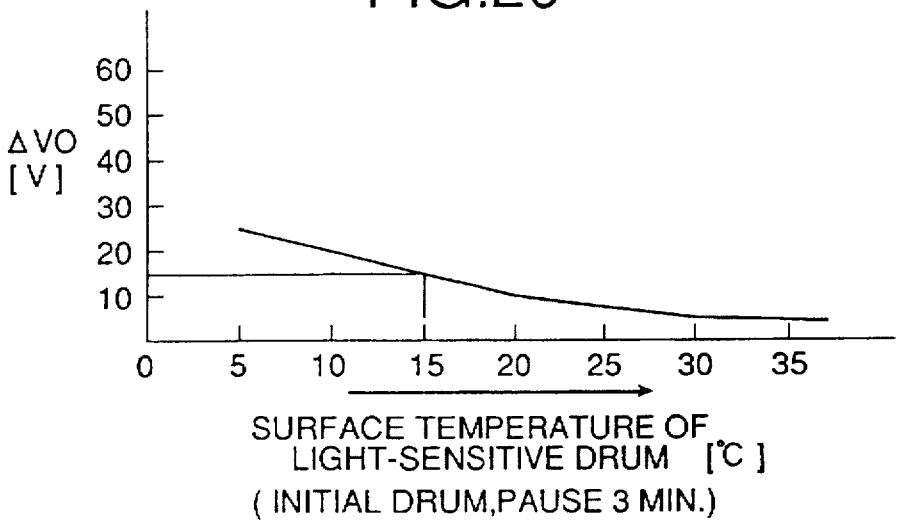
FIG. 26 shows a pause-dependent change of a surface potential of a light-sensitive drum, which is applied to the sixth embodiment of the present invention.

Referring now to FIGS. 2 and 26 to 28, the structure of the sixth embodiment of an image-forming device according to the present invention will be described as follows:

A correlation between a value of ΔVO and temperature of a light-sensitive body was further studied in detail, resulting in obtaining a characteristic curve shown in FIG. 26. The curve shows the fact that a drop ΔVO of a surface potential VO of the light-sensitive body increases as a surface temperature of the light-sensitive body decreases. Accordingly, the sixth embodiment of the present invention is provided with a temperature sensor (e.g., a thermistor) 10 mounted in contact with a non-image area of the light-sensitive drum surface for sensing the temperature thereof with an accuracy of 0.1° C. and realizes the above-described charge-removal prohibiting control when the detected surface temperature is not higher than 15° C., at which the value ΔVO may increase over 15V.

Figure 27:
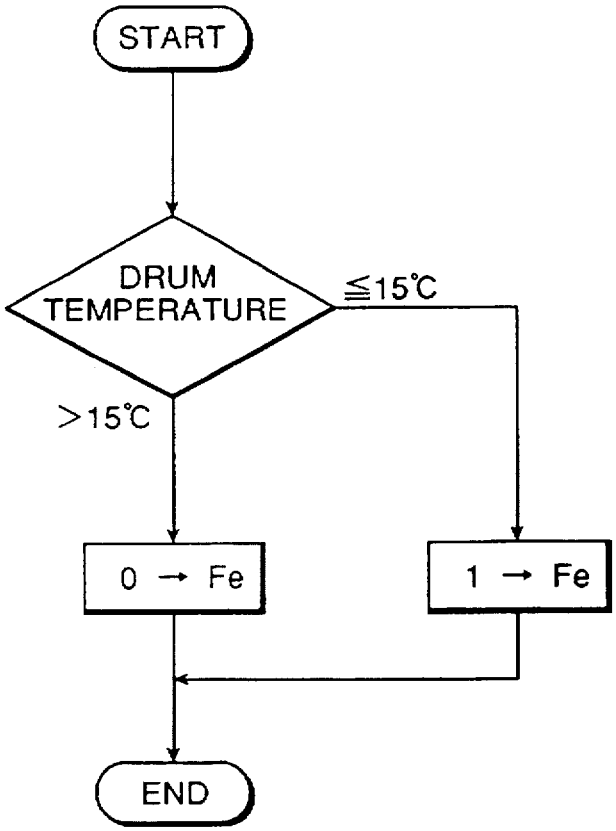
FIG. 27 is a flow chart showing a processing procedure of a control portion of the sixth embodiment of the present invention.

FIG. 27 is a flow chart showing a procedure of setting process parameters. A flag Fe indicating performing the charge-removal prohibiting control is set when a detected surface temperature is not higher than 15° C. or the flag Fe is unset when the detected surface temperature exceeds 15° C.

Figure 28:
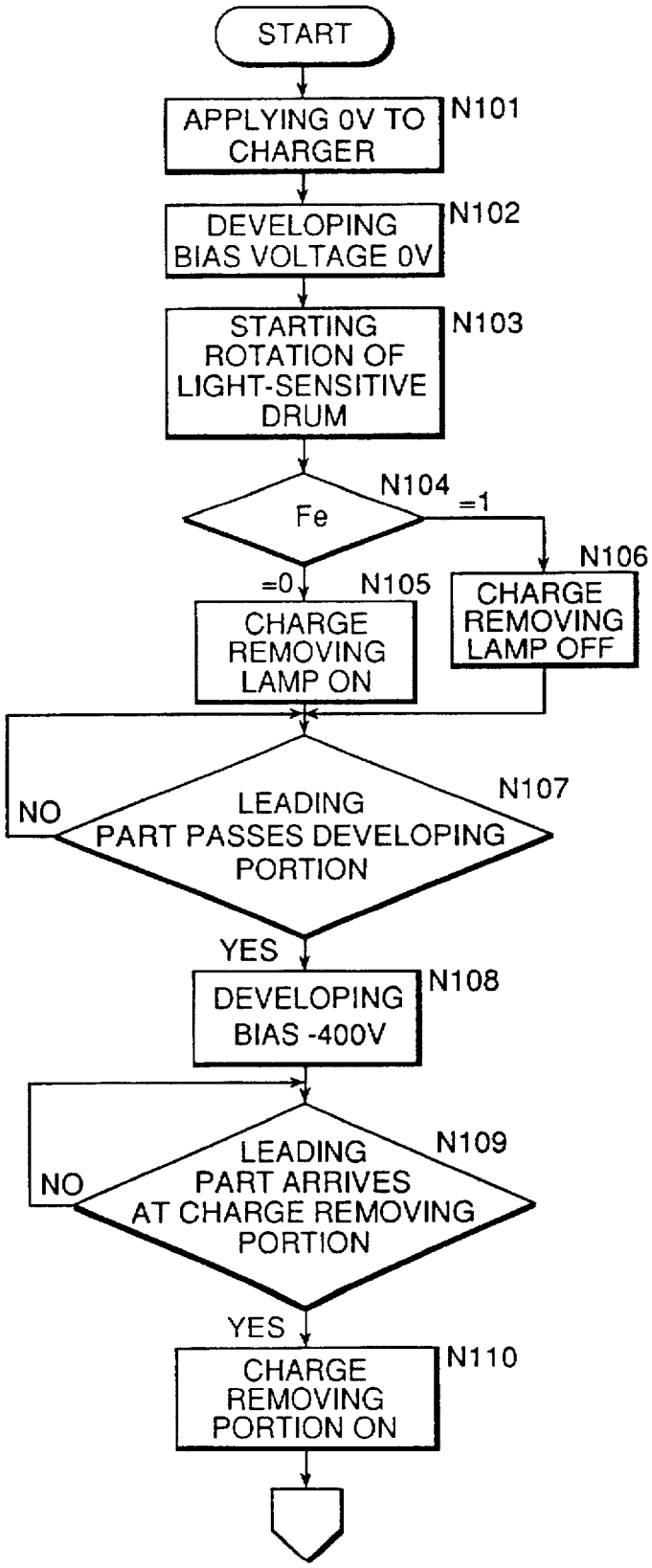
FIG. 28 is a flow chart showing a processing procedure of a control portion of the sixth embodiment of the present invention.

FIG. 28 is a flow chart showing a procedure of an image-forming process. A grid potential of the charger 2 is set first at 0V and a developer bias-potential is set at 0V, then a light-sensitive drum 1 is driven into rotation (N101→N102→N103). A charge-removing lamp 7 is kept OFF when the flag Fe has been set (N104→N106) or the charge-removing lamp 7 is turned ON when the Flag Fe has been set (N105). A developing bias potential of –400V is applied as soon as a leading position on a surface of the rotating light-sensitive body passes a developing portion (N107→N108). When the leading position on the surface of the rotating light-sensitive body arrives at a charge-removing portion, the charge-removing lamp 7 is switched ON (N109→N110).

Figure 29:
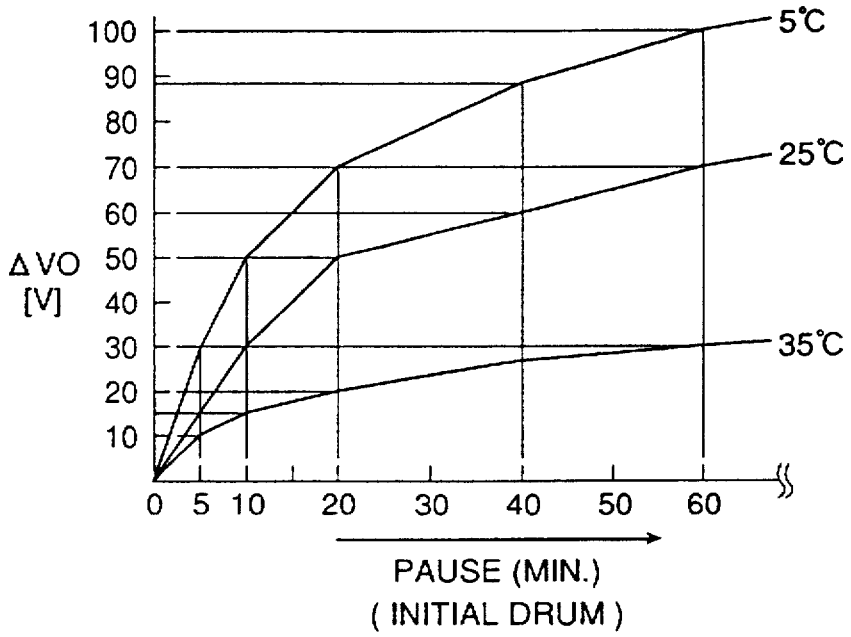
FIG. 29 shows a pause-dependent relation between a change of a surface potential and a surface temperature of a light-sensitive drum, which is used for the seventh embodiment of the present invention.
Figure 30:
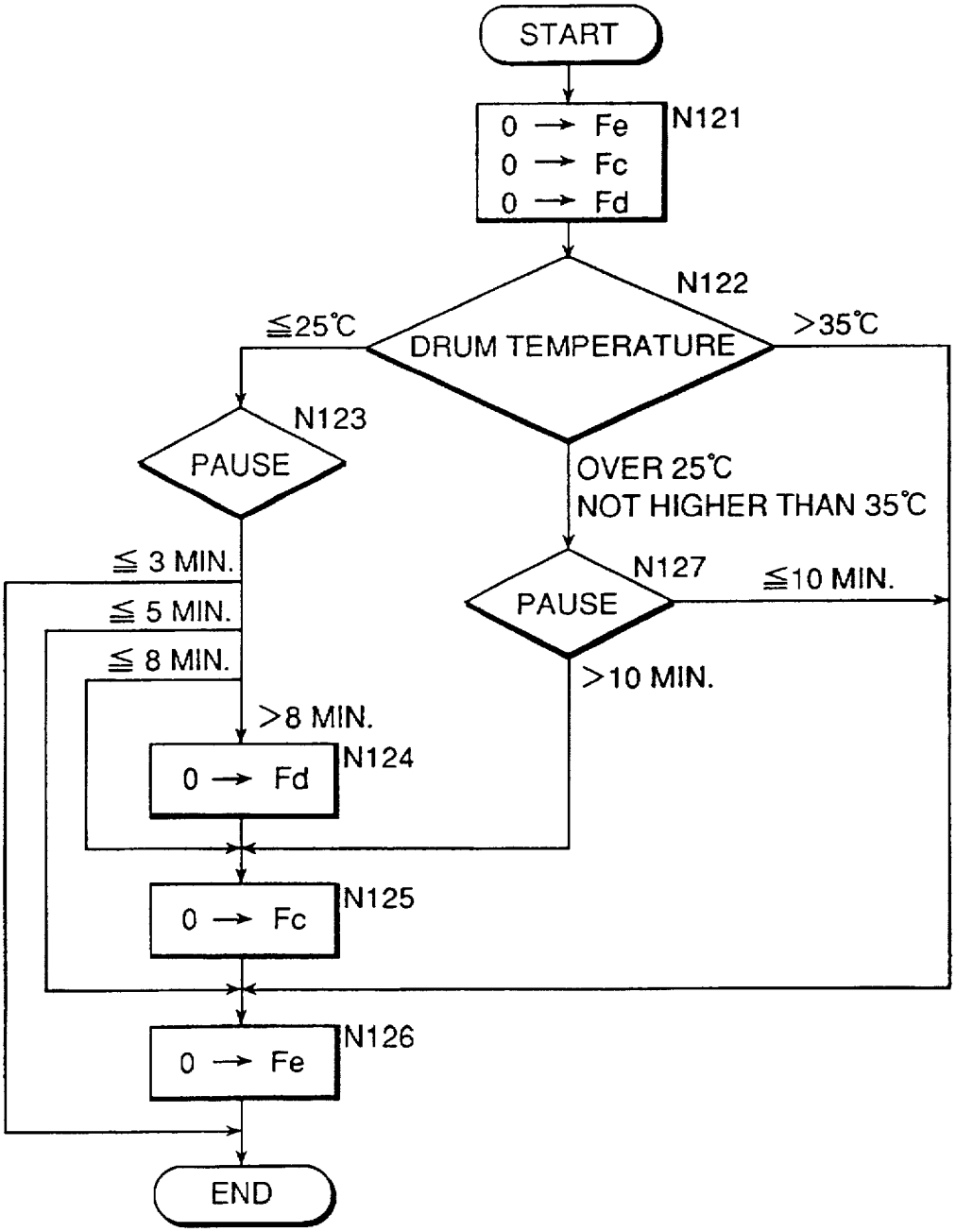
FIG. 30 is a flow chart showing a processing procedure of a control portion of the seventh embodiment of the present invention.

Referring to FIGS. 29 and 30, the structure of the seventh embodiment of an image-forming device according to the present invention will be described as follows:

Fig. 29 shows how much a value of ΔVO changes depending upon an interval (pause) after a preceding image-forming process and a surface temperature of a light-sensitive drum, which has been studied by the Applicant. The characteristic curves of FIG. 29 indicate that the lower the surface temperature is, the more the value of ΔVO becomes with increasing the interval elapsed. Accordingly, the seventh embodiment sets process parameters according to flow chart of FIG. 30. Flags Fd, Fc and Fe are first reset (N121). When the surface temperature of a light-sensitive drum is not higher than 25° C., flags Fd, Fc and Fd are set on the condition that the interval from the preceding process exceeds 8 minutes (N122→N123→N124→N125→N126); flags Fc and Fe are set if the interval is of over 5 to 8 minutes (N123→N125→N126); only the flag Fe is set if the interval is of over 3 to 5 minutes (N123→N126) and all flags Fd, Fc and Fe are unset if the interval is not more than 3 minutes. When the surface temperature of the light-sensitive drum is over 25° C. but not higher than 35° C., the flags Fc and Fe are set on the condition the interval is longer than 10 minutes (N122→N127→N125→N126) and only flag Fe is set if the interval is not more than 10 minutes (N127→N126). When the surface temperature of the light-sensitive drum is over 35° C., only the flag Fe is set (N122→N126).

After completion of setting the above-mentioned process parameters, this embodiment performs the same control operations shown in FIG. 23 as follows:

When the value of ΔVO is not more than 15V, the charge-removal prohibiting control, the charger-potential changing control and the developer-potential changing control are omitted and an ordinary process is performed from the first time of rotation. Only the charge-removal prohibiting control is conducted when ΔVO is in the range of over 15 to 30V. The charge-removal prohibiting control and the charger-potential changing control are conducted when ΔVO is in the range of over 30 to 40V. The charge-removal prohibiting control, the charger-potential changing control and the developer-potential changing control are carried-out when ΔVO is more than 40V.

Figure 31:
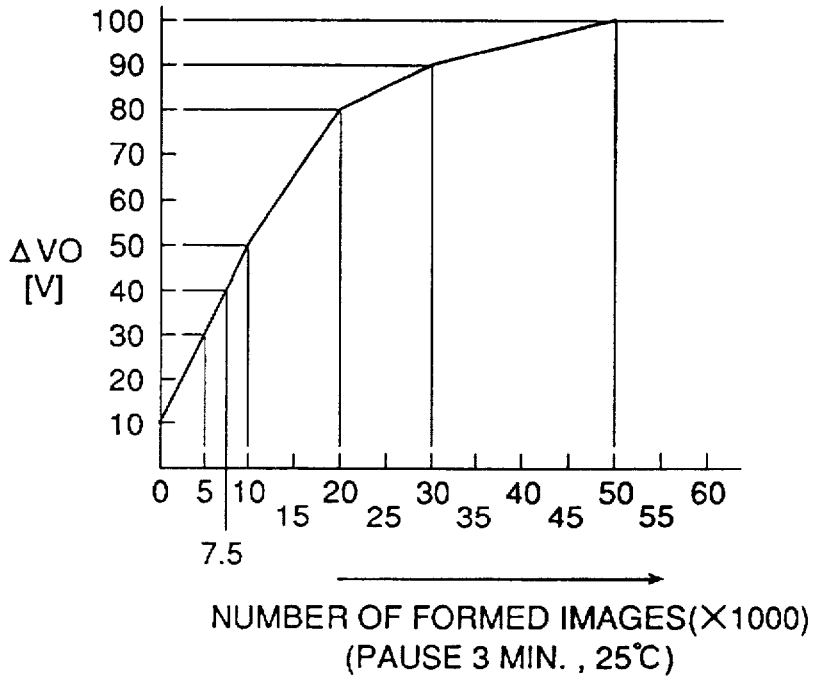
FIG. 31 shows a change of a surface potential of a light-sensitive drum depending upon the number of images formed thereon.
Figure 32:
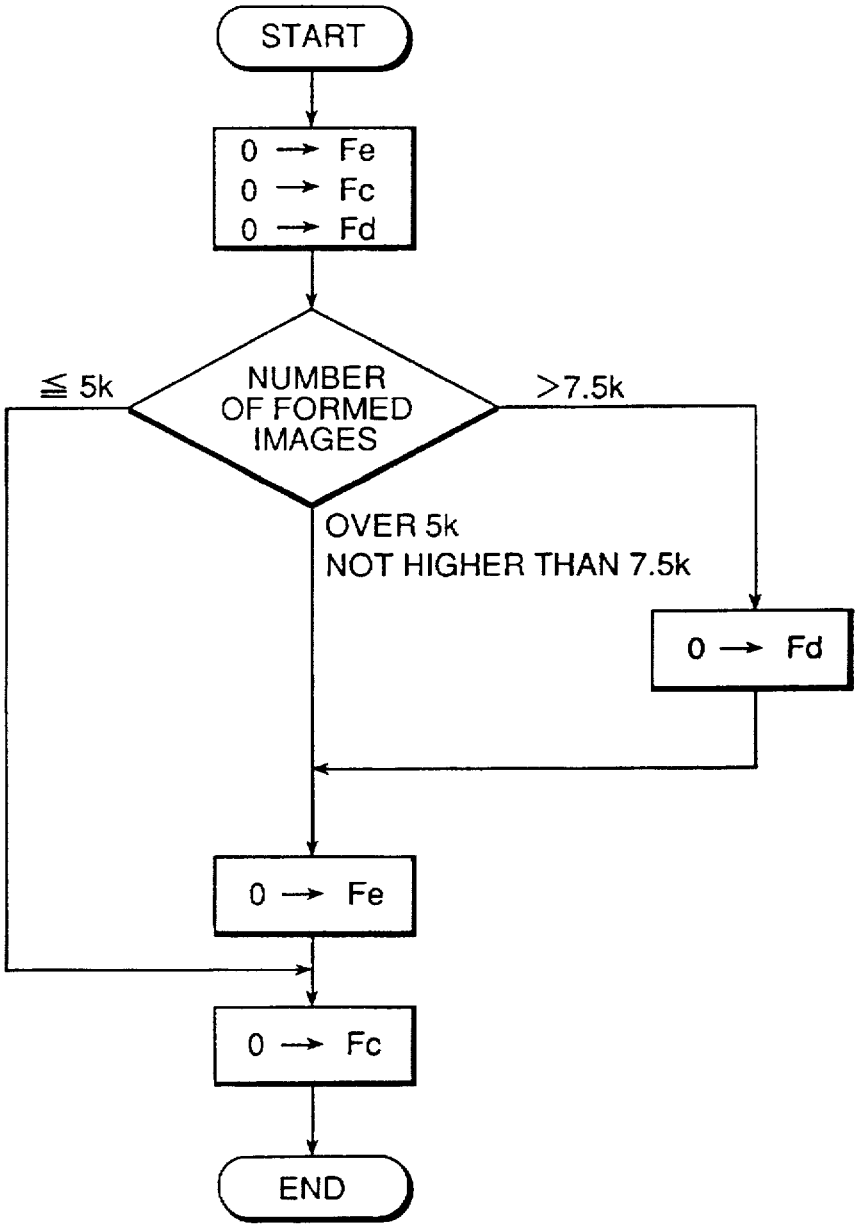
FIG. 32 is a flow chart showing a processing procedure of a control portion of the eighth embodiment of the present invention.

Referring to FIGS. 31 and 32, the structure of the eighth embodiment of an image-forming device according to the present invention will be described as follows:

FIG. 31 shows how much a value of ΔVO changes depending upon a quantity of images formed at a surface temperature of 25° C. on a light-sensitive drum, which has been studied by the Applicant. The characteristic curve of FIG. 31 indicates that increasing the number of formed images causes the light-sensitive bode to be light-fatigued and have electron traps formed therein. The value of ΔVO is therefore increased and attains a saturated value whereat the number of formed images is 50000. Accordingly, the eighth embodiment of the present invention is provided with facilities for counting the number of formed images and storing the counted data. The embodiment conducts setting process parameters according to the procedure shown in FIG. 32. Namely, a flag Fe is set when the number of formed images is not more than 5000; flags Fc and Fe are set when the number of formed images is in the range of over 5000 to 7500; flags Fd, Fc and Fe are all set when the number of formed images exceeds 7500. After setting the process parameters, an image-forming process is carried out according to the procedure of FIG. 32.

Figure 33:
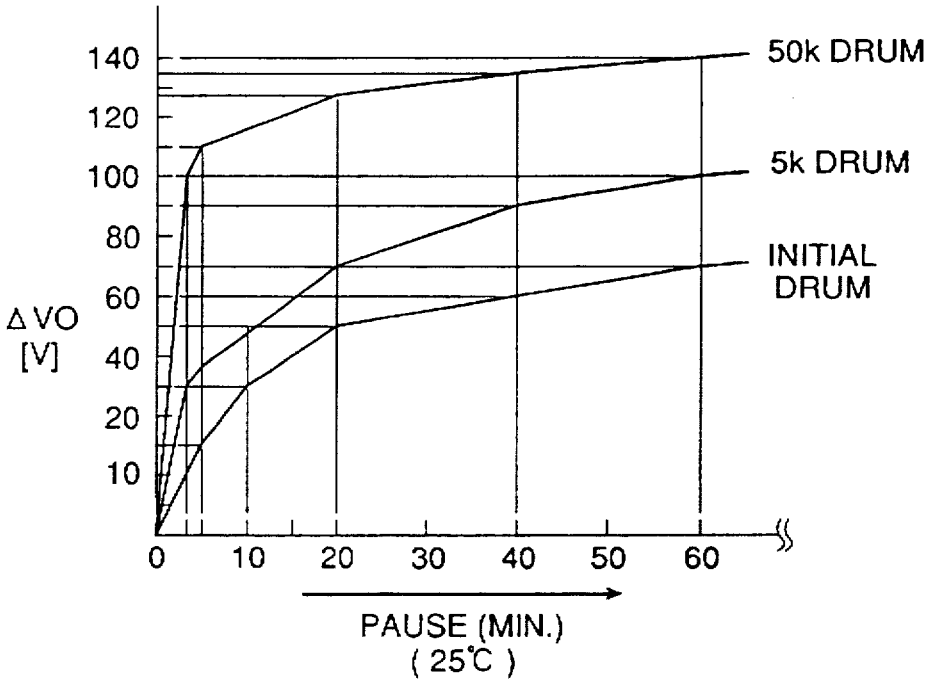
FIG. 33 shows a pause-dependent drop of a surface potential of a light-sensitive drum using a parameter of the number of images formed thereon.
Figure 34:
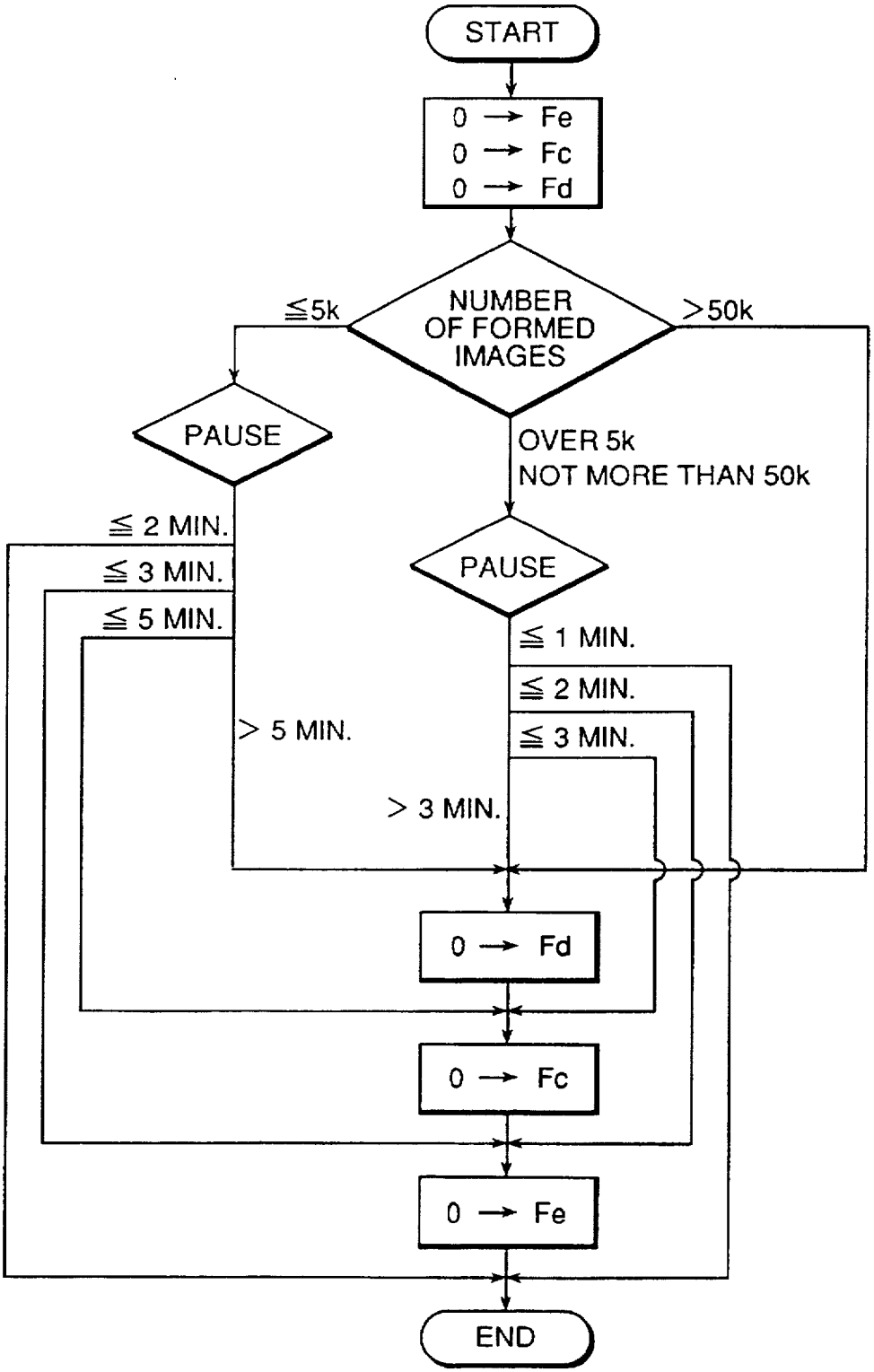
FIG. 34 is a flow chart showing a processing procedure of a control portion of the ninth embodiment of the present invention.

Referring to FIGS. 33 and 34, the structure of an image forming device, which relates to the ninth embodiment of the present invention, will be described as follows:

FIG. 33 shows how much the number of formed images influences a pause-dependent change of ΔVO, which has been studied by the Applicant. In FIG. 33, a characteristic curve "initial drum" relates to a light-sensitive drum to be newly used for an image forming process, a curve "5 k drum" relates to a light-sensitive drum which has been used for forming 5000 images thereon and curve "50 k drum" relates to a light-sensitive drum which has been used for forming 50000 images thereon. The light-sensitive drum may be light-fatigued with increasing the number of images formed thereon, resulting in increasingly accumulating electron traps therein. The value of ΔVO increases by the effect of the electron traps with time elapsed after a preceding image-forming process. In FIG. 33 a maximal saturated value ΔVO is found on the curve "50 k drum" of the light-sensitive drum which has been used for forming 50000 images and has paused for 60 minutes after a preceding image-forming process. In this case, ΔVO becomes as large as 140V and may considerably degradate images to be formed by causing a remarkable fogging and a large variation of optical density. To cope with this problem, the ninth embodiment is provided with means for accumulatively counting the number of formed images and means for storing the count result and sets process parameters according to a procedure shown in FIG. 34. For the light-sensitive drum which has formed thereon not more than 5000 images, flags Fe, Fc and Fd are all unset if the time elapsed after a preceding image-forming process is not more than 2 minutes; only flag Fe is set if the time elapsed is over 2 minutes but does not exceed 3 minutes; only flags Fc and Fe are set if the time elapsed is over 3 minutes but does not exceed 5 minutes; and all flags Fd, Fc and Fe are set if the time elapsed exceeds 5 minutes. For the light-sensitive drum which has formed more than 5000 and not more than 50000 images thereon, flags Fe, Fc and Fd are all unset if the time elapsed is not more than 1 minute; only flag Fe is set if the time elapsed is over 1 minute but does not exceed 2 minutes; flags Fc and Fe are set if the time elapsed is over 2 minute but does not exceed 3 minutes; and all flags Fd, Fc and Fe are set if the time elapsed is in excess of 3 minutes. For the light-sensitive drum which has formed more than 50000 images thereon, all flags Fd, Fc and Fe are always set.

Figure 35:
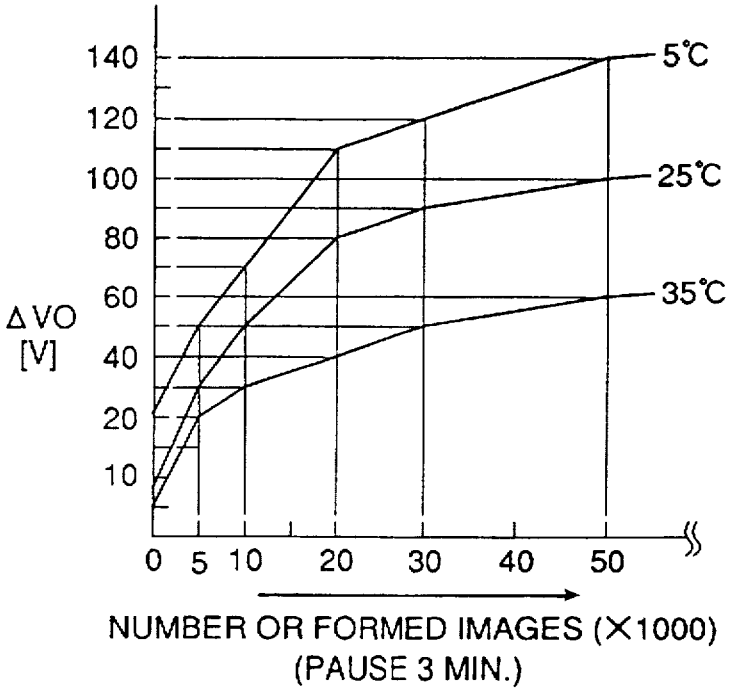
FIG. 35 shows a correlation between a drop of a surface potential of a light-sensitive drum and the number of formed images, using a parameter of a surface temperature of the light-sensitive drum.
Figure 36:
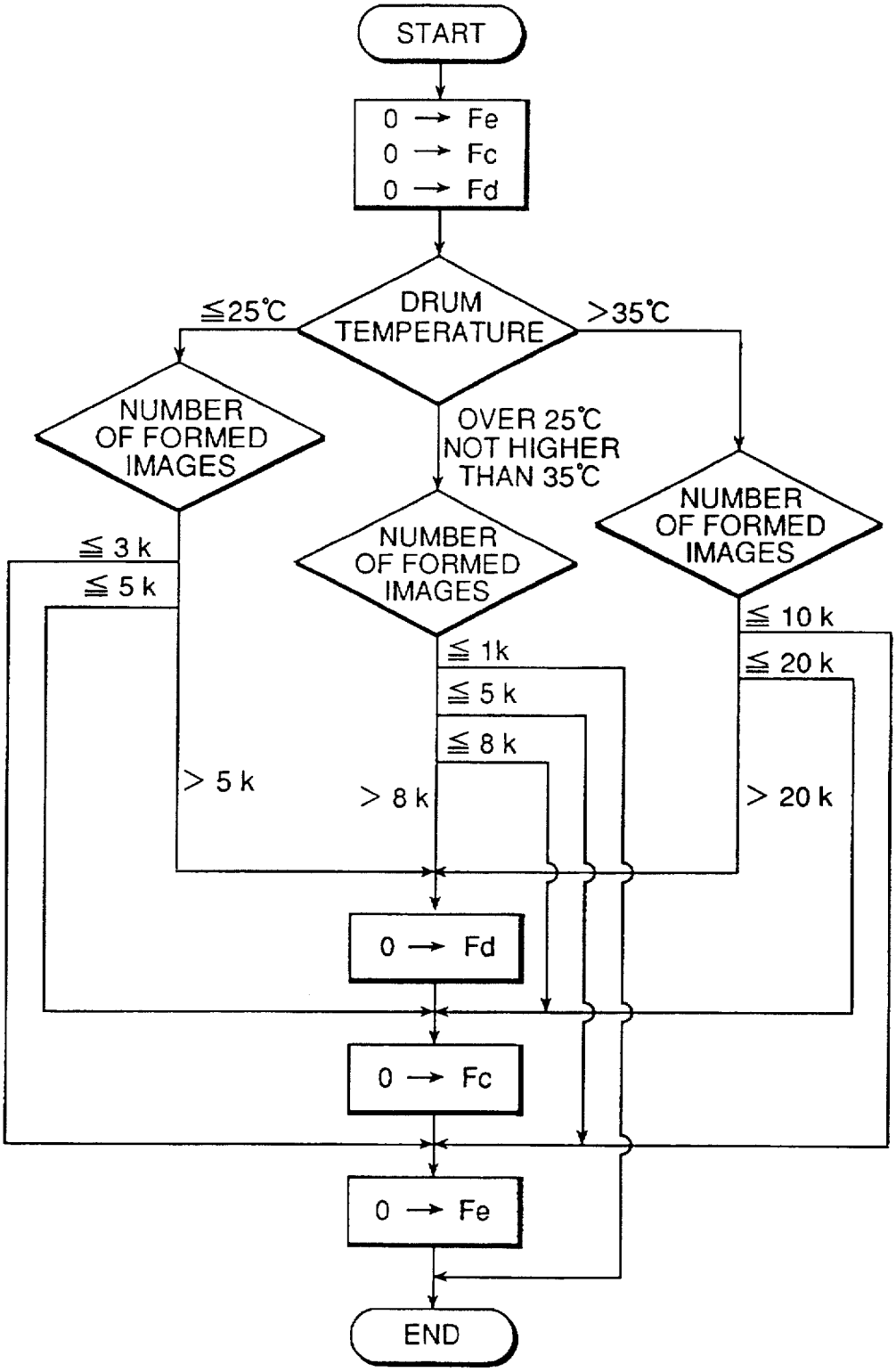
FIG. 36 is a flow chart showing a processing procedure of a control portion of the tenth embodiment of the present invention.

Referring to FIGS. 35 and 36, the structure of an image forming device, which relates to the tenth embodiment of the present invention, will be described as follows:

FIG. 35 shows how much the value ΔVO changes with increasing the number of formed images using a surface temperature of a light-sensitive drum as a parameter. The light-sensitive body is increasingly light-fatigued with increasing the number of images formed thereon and may have an increased number of electron traps generated therein, which have an influence on a drop of a charge potential VO. The graph of FIG. 35 indicates that a drop of the charge potential VO due to the electron traps may increase at a lower surface temperature of light-sensitive drum. For example, when a light-sensitive drum which has formed 50000 images thereon is left with no load at a low temperature of 5° C. for 3 minutes, the charge potential VO drops by 140V, causing a considerable degradation of an imaged to be formed with an increased fogging and a large variation of optical density. In particular, the similar conditions may occur in case that a facsimile automatically receive and prints-out data at a low ambient temperature at the night in unmanned condition. Accordingly, the tenth embodiment first sets process parameters according to a procedure shown in FIG. 36. Namely, when a surface temperature of a light-sensitive drum is not higher than 25° C., only flag Fe is set if the drum has formed not more than 3000 images thereon; flags Fc and Fe are set if the drum has formed over 3000 to 5000 images thereon; and all flags Fd, Fc and Fe are set if the drum has formed more than 5000 images thereon. When a surface temperature of the light-sensitive drum is in the range of over 25° C. to 35° C., all flags Fd, Fc and Fe are unset for the drum having formed not more than 1000 images thereon; only flag Fe is set for the drum having formed over 1000 to 5000 images thereon; flags Fc and Fe are set for the drum having formed over 5000 to 8000 images thereon; and all flags Fd, Fc and Fe are set for the drum having formed more than 8000 images thereon. When a surface temperature of the light-sensitive drum exceeds 35° C., only flag Fe is set for the drum having formed not more than 10000 images thereon; flags Fc and Fe are set for the drum having formed over 10000 to 20000 images thereon; and all flags Fd, Fc and Fe for the drum having formed more than 20000 images thereon.

Then, the process shown in FIG. 23 is performed to form an image with adaptive control of the value ΔVO.

Figure 37:
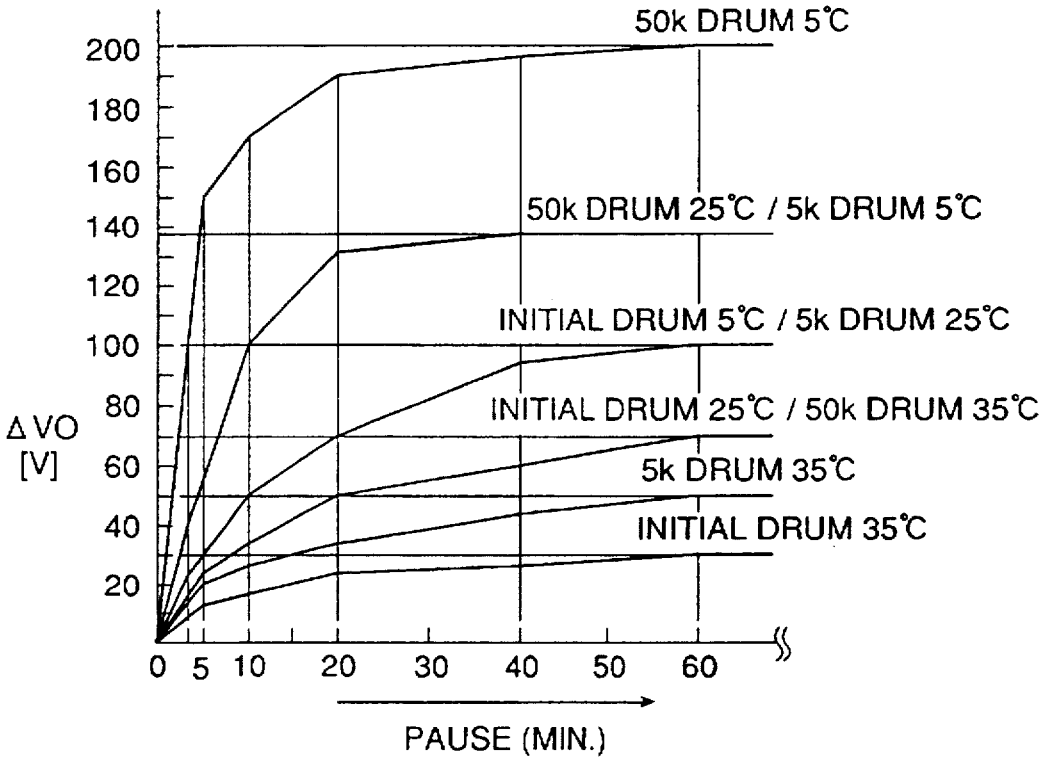
FIG. 37 shows a pause-dependence drop of a surface potential of a light-sensitive drum, using two parameters—a temperature of the light-sensitive drum and the number of images formed thereon.
Figures 39A, 39B:
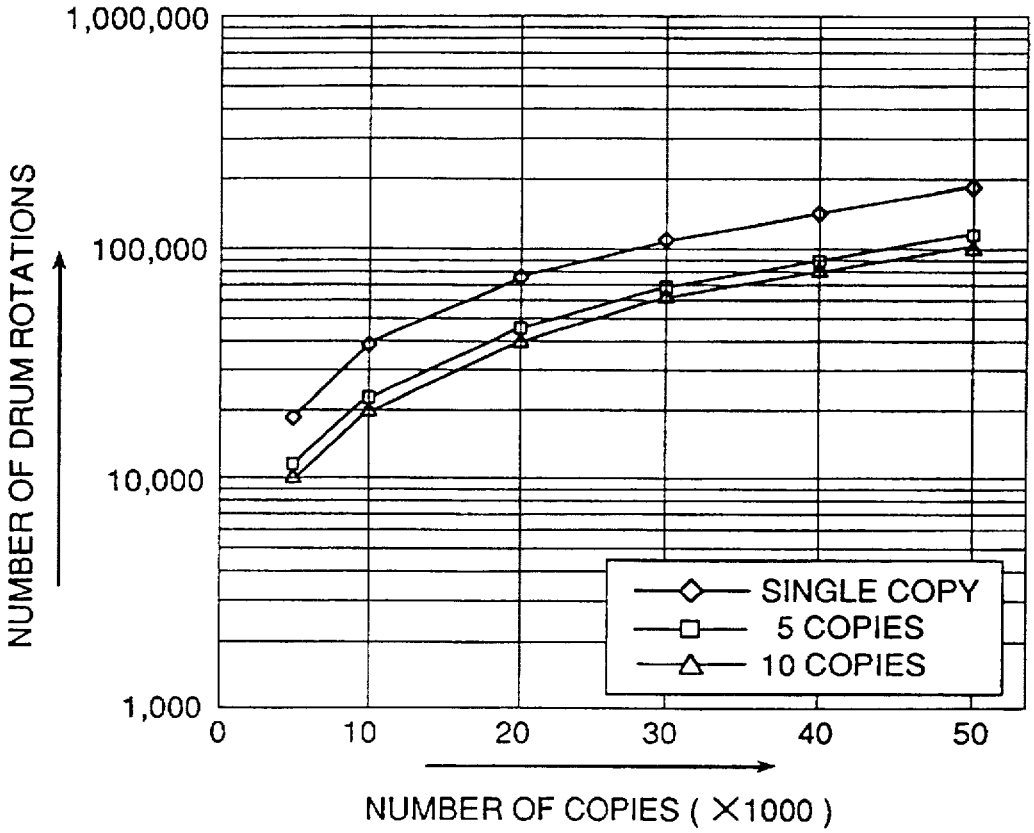
FIG. 39A and 39B show a correlation between the number of copies and the number of rotations of a light-sensitive drum.

Referring to FIGS. 37 and 38, the structure of an image forming device, which relates to the eleventh embodiment of the present invention, is described as follows:

FIGS. 39A and 39B show a pause-dependent change of ΔVO using as parameters the number of formed images and a surface temperature of a light-sensitive drum. The light-sensitive body is increasingly light-fatigued with increasing the number of images formed thereon and may have an increased number of electron traps generated therein, which have an influence on a drop of a charge potential VO. The graph of FIGS. 39A and 39B show that a drop ΔVO of a charge potential VO due to the electron traps increases with lowering a surface temperature of the light-sensitive body. For example, when a light-sensitive drum which has formed 50000 images thereon is left at a low temperature of 5° C. for 60 minutes, the charge potential VO drops by 200V for the first rotation of the light-sensitive drum, causing a considerable degradation of an imaged to be formed with an increased fogging and a large variation of its optical density. This also results in an increased consumption of toner. To cope with this problem, the eleventh embodiment first sets process parameters according to a rule shown in FIG. 38. For example, with a light-sensitive drum having formed not more than 5000 images and having a surface temperature of not higher than 25° C., all flags Fd, Fc and Fe are unset if the drum has paused for not more than 1 minute after a preceding image-forming process, and only flag Fe is set if the drum has paused for more than 1 minute. With a light-sensitive drum having formed more than 5000 images thereon and having its surface temperature of not higher than 25° C., only flag Fe is set if the drum has paused for not more than 30 seconds; flags Fc and Fe are set if the drum has paused for not more than 1 minute; and all flag Fd, Fc and Fe are set if the drum has paused for more than 1 minute. All flags Fd, Fc and Fe are also set for a light-sensitive drum which has formed more than 5000 images thereon and paused for more than 15 minutes and which surface temperature exceeds 35° C.

The process shown in FIG. 23 is then performed to form an image with adaptive control for ΔVO.

Referring to FIGS. 39A, 39B and 40, an image forming device, which is the twelfth embodiment of the present invention, will b e explained as follows:

For example, a copying machine may have different numbers of rotations of its light-sensitive drum per image to be formed thereon when it works in single copy mode for printing an image on one sheet by single press of a print switch and in multi-copy mode for successively printing an image on a plurality of sheets by single press of the print switch. FIGS. 39A and 39B show a correlation between the number of rotations of the light-sensitive drum and the number of copies for single copy mode and multi-copy mode. For example, the light-sensitive drum must rotate 18691 times for copying 5000 originals on 5000 sheets in the single copy mode and 11214 times for copying 5000 originals on 5000×5 sheets in the 5-sheet multi-copy mode. Namely, the number of rotations of the light-sensitive drum per copy in the single copy mode is 1.67 times larger than that in the 5-sheet multi-copy mode. A drop of a charge potential VO on the light-sensitive drum, which occurs by the effect of electron traps produced due to light-fatigue of the light-sensitive material and which depends upon a time elapsed after a preceding image forming process, more correctly corresponds to the number of rotations of the light-sensitive drum. Therefore, it is better to measure the number of rotations of the light-sensitive drum than to measure the number of images formed thereon.

Accordingly, the twelfth embodiment of the present invention uses means for determining a total rotation time of the light-sensitive drum from a total count of rotation time of a drum driving motor and means for storing the determined total rotation time of the drum and sets process parameters according to a rule shown in FIG. 40. For example, with a light-sensitive drum having a surface temperature of not higher than 25° C. and having a total rotation time of not more than 20000 seconds, all flags Fd, Fc and Fe are unset if the drum has paused for not more than 1 minute after a preceding image forming process, and only flag Fe is set if the drum has paused for more than 1 minute. With a light-sensitive drum having a total rotation time of over 20000 seconds, only flag Fe is set if the drum has paused for not more than 30 seconds, flags Fc and Fe are set if the drum has paused for not more than 1 minute, all flags Fd, Fc and Fe are set if the drum has paused for more than 1 minute. All flags Fd, Fc and Fe are also set when the light-sensitive drum has its surface temperature of higher than 35° C., has a total rotation time of more than 20000 seconds and has paused for more than 15 minutes.

The embodiment performs the process shown in FIG. 23 to form an image with adaptive control for ΔVO.

An image forming device according to the present invention is capable of omitting the step of removing charge from uncharged area of the light-sensitive drum according to a pause between the image forming processes, prevent occurrence of a large potential difference between the uncharged area and the other area and begin an image forming process earlier without impairing the image forming conditions, and is also capable of preventing the occurrence of fogging on a non-image area and to reduce a running cost of the copying machine by saving the consumption of toner and elongating the life time of the cleaning means used.

An image forming device according to the present invention is capable of judging the need of removing charge from uncharged area of the light-sensitive drum in view of an ambient temperature that can influence a change of a potential difference between the uncharged area and the other area of the light-emitting drum, and to begin an image forming process earlier without impairing the image forming conditions even when the ambient temperature changes.

An image forming device according to the present invention is capable of judging whether removing a charge from the uncharged area is needed or not in view of an aged characteristic change of the light-sensitive drum and, thereby, to early begin the image forming process, keeping a stable state for uniformly forming an image even with an aged characteristic change of the light-sensitive material.

An image forming device according to the present invention, is capable of preventing variation of a surface potential of a light-sensitive body by prohibiting the removal of electrostatic charge by charge removing means before charging and of stabilizing a surface potential of the light-sensitive body for the first time of its rotation by selectively changing a potential of charge to be applied to the electrically charging means for the period the light-sensitive body rotates by 360 degrees to its initial position facing to the electrically charging means to be different from a potential to be applied to the electrically charging means after the first rotation of the light-sensitive body.

An image forming device according to the present invention is capable of obtaining the same image density of an image formed by the first rotation of a light-sensitive body as that being obtainable by the second and further rotations even in case when an initial potential is still lower than the specified value to be obtainable by the proceeding rotations by adaptively changing bias potential to a developing means to increase a developing potential difference which is a difference between a potential (VL) of an optical-image exposing portion and a developing bias potential.

An image forming device according to the present invention is capable of obtaining a good-quality image at the first rotation of a light-sensitive body by adaptively performing an image forming process according to an extent of a change of a surface potential of the light-sensitive body depending upon a light-fatigue and a temperature of the light-sensitive body and/or a pause after the preceding image process.

We claim:

1. An image forming device, comprising electrically charging means for charging a surface of a light-sensitive body with a unipolar electrical charge, developing means for applying developer to a surface of the light-sensitive body with an electrostatic latent image formed by radiation of an optical image on an electrically charged surface of the light-sensitive body, transfer means for transferring a developed image from the light-sensitive body onto a transfer material and charge removing means for removing residual electrostatic charge from light-sensitive body after transferring by the transfer means the developed image therefrom to the transfer material, characterized in that the device is further provided with charge-removal prohibiting means for prohibiting the removal of electrostatic charge by the charge removing means for a period from the time when light-sensitive body opposes at its part to the static charging means at the start of an image forming process to the time when the light-sensitive body opposes at said part to the charge removing means and judging means for judging the need of using the charge-removal prohibiting means depending upon a pause between two successive image forming processes.

2. An image forming device as defined in claim 1, characterized in that the judging means includes means for judging the need of using the charge-removal prohibiting means depending upon a change of internal temperature of the device.

3. An image forming device as defined in any one of claims 1 and 2, characterized in that the judging means includes means for judging the need of using the charge-removal prohibiting means depending upon an aged characteristic change of the light-sensitive body of the device.

4. An image forming device, comprising electrically charging means for charging a surface of a light-sensitive body with a unipolar electrical charge, developing means for applying developer to a surface of the light-sensitive body with an electrostatic latent image formed by radiation of an optical image on an electrically charged surface of the light-sensitive body, transfer means for transferring a developed image from the light-sensitive body onto a transfer material and charge removing means for removing residual electrostatic charge from light-sensitive body after transferring by the transfer means the developed image therefrom to the transfer material, characterized in that the device is further provided with charge-removal prohibiting means for prohibiting the charge removing means from removing electrostatic charge for a period the light-sensitive body makes a rotation of 360 degrees and re-locates its leading position at the same initial position facing to the electrically charging means, and charge-potential changing means for selectively changing a potential of charge to the electrically charging means for the period the light-sensitive body rotates by 360 degrees to its initial position facing to the electrically charging means to be different from a potential to be applied to the electrically charging means after the first 360-degree rotation of the light-sensitive body.

5. An image forming device as defined in claim 4, characterized in that the device is further provided with developing bias-potential changing means for selectively changing a bias potential to be applied to the developing means for a first 360-degree rotation of the light-sensitive body with its charged area being opposed to the developing means to be different from a bias potential to be applied to the developing means for a second and further rotations of the light-sensitive body.

6. An image forming device as defined in claim 5, characterized in that the device further includes judging means for judging a degree of change of a surface potential of an electrical charge on a surface of the light-sensitive body on the basis of a light fatigue, a temperature and a time elapsed after a preceding image-forming process, and image-forming-process control means which forces only the charge-removal prohibiting means to be active if the potential change is judged to be small, both the charge-removal prohibiting means and the charge-potential changing means to be active if the potential change is judged to be average, and all the charge-removal prohibiting means, the charge-potential changing means and the developing bias-potential changing means to be active if the potential change is judged to be large.

* * * * *